US011939107B2

(12) United States Patent
Clark et al.

(10) Patent No.: US 11,939,107 B2
(45) Date of Patent: Mar. 26, 2024

(54) PALLET WITH IMPACT RESISTANT AND STRENGTHENED COMPOSITE LEGS

(71) Applicant: Artistic Composite Pallets LLC, Carmel, IN (US)

(72) Inventors: Garrett Clark, Carmel, IN (US); William A. Bastian, II, Carmel, IN (US)

(73) Assignee: Artistic Composite Pallets LLC, Carmel, IN (US)

( * ) Notice: Subject to any disclaimer, the term of this patent is extended or adjusted under 35 U.S.C. 154(b) by 0 days.

(21) Appl. No.: 17/804,943

(22) Filed: Jun. 1, 2022

(65) Prior Publication Data

US 2023/0391498 A1 Dec. 7, 2023

(51) Int. Cl.
*B65D 19/00* (2006.01)
*B65D 19/38* (2006.01)

(52) U.S. Cl.
CPC ..... *B65D 19/0024* (2013.01); *B65D 19/38* (2013.01)

(58) Field of Classification Search
CPC ..... B65D 19/38; B65D 19/0024
USPC ..... 108/57.28
See application file for complete search history.

(56) References Cited

U.S. PATENT DOCUMENTS 2,673,052 A * 3/1954 Risch ..... D21J 3/00 248/188.8
3,159,115 A 12/1964 Nolan
3,438,342 A * 4/1969 Woolworth ..... B65D 19/0028 108/158
3,581,681 A 6/1971 Newton
3,619,457 A 11/1971 Chandler et al.
3,966,529 A 6/1976 Kuroda
4,128,253 A * 12/1978 Powers ..... B65D 19/44 108/56.1
4,226,203 A 10/1980 Marcin
4,267,781 A * 5/1981 Powers ..... B65D 19/0012 108/56.1
4,280,974 A 7/1981 Piazza
4,393,999 A 7/1983 Forshee
4,504,320 A 3/1985 Rizer et al.
4,621,468 A 11/1986 Likozar
4,843,976 A * 7/1989 Pigott ..... B65D 19/0012 24/453
5,057,350 A * 10/1991 Gezels ..... B65D 19/0026 428/36.5

(Continued)

FOREIGN PATENT DOCUMENTS

CN 1565934 A 1/2005
CN 1646311 A 7/2005

(Continued)

*Primary Examiner* — Daniel J Troy
*Assistant Examiner* — Timothy M Ayres
(74) *Attorney, Agent, or Firm* — Woodard, Emhardt, Henry, Reeves & Wagner, LLP

(57) ABSTRACT

A pallet includes a deck and one or more leg-plank bridges that extend from the deck. The leg-plank bridges include one or more legs and a plank that extends between the legs. The legs and plank are integrally formed together and attached to the deck. The legs have one or more internal walls that define one or more cavities. Concrete fills the cavities of the legs located on a lead end of the pallet. The remaining cavities in the legs are filled with foam. The cavities in one version are wedge shaped. Other legs of the deck are filled entirely with foam.

19 Claims, 34 Drawing Sheets

(56) References Cited

U.S. PATENT DOCUMENTS

| | | | | |
|---|---|---|---|---|
| 5,095,674 | A | 3/1992 | Huettemann | |
| 5,197,395 | A * | 3/1993 | Pigott | B65D 19/0012 108/56.1 |
| 5,229,051 | A | 7/1993 | Martin | |
| D354,606 | S * | 1/1995 | Pigott | D34/38 |
| 5,388,533 | A | 2/1995 | Pigott et al. | |
| 5,413,052 | A | 5/1995 | Brezzer et al. | |
| 5,425,521 | A | 6/1995 | Locke | |
| 5,675,956 | A | 10/1997 | Nevin | |
| 5,833,394 | A | 11/1998 | McCavour | |
| 6,083,318 | A | 7/2000 | Zawada et al. | |
| 6,210,069 | B1 * | 4/2001 | Speck | B65D 19/18 410/82 |
| 6,352,039 | B1 | 3/2002 | Woods et al. | |
| 6,739,797 | B1 | 5/2004 | Schneider | |
| 6,745,703 | B2 | 6/2004 | Torrey et al. | |
| 6,758,148 | B2 | 7/2004 | Torrey et al. | |
| 6,969,423 | B2 | 11/2005 | Li et al. | |
| 6,972,144 | B2 | 12/2005 | Roth et al. | |
| 6,976,345 | B2 | 12/2005 | Keshmiri | |
| 7,347,148 | B2 | 3/2008 | Roth et al. | |
| 7,908,979 | B2 | 3/2011 | Yoshida et al. | |
| 8,104,242 | B1 | 1/2012 | Fouad et al. | |
| 8,146,516 | B2 | 4/2012 | Linares | |
| 8,181,580 | B2 | 5/2012 | Roth et al. | |
| 8,397,649 | B2 | 3/2013 | Smith et al. | |
| 8,438,981 | B2 | 5/2013 | Linares | |
| 8,813,660 | B2 | 8/2014 | Linares | |
| 9,102,086 | B2 | 8/2015 | Roberts | |
| 9,138,945 | B2 | 9/2015 | Rimmer et al. | |
| 9,272,484 | B2 | 3/2016 | Roberts, Jr. | |
| 10,377,527 | B2 | 8/2019 | Bastian et al. | |
| 2002/0162295 | A1 | 11/2002 | Keshmiri | |
| 2005/0155528 | A1 | 7/2005 | Moore | |
| 2006/0147681 | A1 | 7/2006 | Dubey | |
| 2006/0288914 | A1 | 12/2006 | Lee | |
| 2008/0072796 | A1 | 3/2008 | Utagaki et al. | |
| 2008/0110377 | A1 | 5/2008 | Stevens | |
| 2008/0157428 | A1 | 7/2008 | Utagaki et al. | |
| 2008/0178771 | A1 | 7/2008 | Utagaki et al. | |
| 2010/0116180 | A1 | 5/2010 | Roth et al. | |
| 2010/0218705 | A1 | 9/2010 | Mani | |
| 2011/0120353 | A1 | 5/2011 | Jensen et al. | |
| 2012/0266785 | A1 | 10/2012 | Apps | |
| 2013/0032507 | A1 | 2/2013 | Du Toit et al. | |
| 2014/0137727 | A1 | 5/2014 | Riley | |
| 2015/0218049 | A1 | 8/2015 | Andersen et al. | |
| 2015/0251952 | A1 | 9/2015 | Byrd | |
| 2016/0368659 | A1 | 12/2016 | Bastian, II et al. | |
| 2018/0282017 | A1 * | 10/2018 | Bastian, II | B65D 19/0073 |

FOREIGN PATENT DOCUMENTS

| | | | |
|---|---|---|---|
| CN | 1752377 | A | 3/2006 |
| CN | 101342958 | A | 1/2009 |
| CN | 103693270 | A | 4/2014 |
| EP | 0358577 | A1 | 3/1990 |
| EP | 0583796 | A1 | 2/1994 |
| JP | 2009166882 | A | 7/2009 |
| KR | 101249281 | B1 | 4/2013 |
| WO | 1994010052 | A2 | 5/1994 |

* cited by examiner

PALLET WITH IMPACT RESISTANT AND STRENGTHENED COMPOSITE LEGS

BACKGROUND

Pallets are commonly used to store and haul various goods and other objects. Typical pallets are designed to be moved by forklift trucks or hand-drawn pallet jacks. However, the pallets can be damaged when moved.

Thus, there is a need for improvement in this field.

SUMMARY

A unique pallet design has been developed to enhance durability and strength as well as to reduce the weight of the pallet. The exterior of the pallet is typically made of plastic or other similar material. The pallet further includes foam inserts to reduce the overall weight of the pallet. In particular, the pallet includes legs that are partially or fully filled with foam inserts. Some legs of the pallet are at locations that are less prone to being impacted and damaged during routine use, while other legs have higher risks of being damaged. The legs with the lower risk of damage are filled completely with the foam insert so as to reduce the weight of the pallet. The legs with the higher risk of damage in one version are only partially filled with the foam insert, and the remaining part is filled with a reinforcing material that is stronger and/or more durable than the foam used in the inserts. The side of the legs that have the higher risk of damage in one version are filled with concrete, so as to enhance the strength and durability of the legs. In one form, the concrete includes an Engineered Cementous Composite (ECC) material due to the relatively low weight and high durability of the ECC material.

Pallet legs getting pierced or otherwise penetrated was found to be a significant source of pallet damage. Filling at least some of the legs at strategic positions with concrete, such as ECC material, alleviates this issue. For instance, the ECC gives the legs the strength to withstand a forklift truck pushing two or more pallets into the back of a trailer. Commonly, forklift truck operators push the fork tines against the pallet legs because the operator does not want to drive the forklift truck over a dock leveler and into the back of a trailer. Some forklift truck operators have found it easier and faster to just push on the last pallet to move all pallets lined up further into the trailer. This was discovered to be a major source of pallet leg damage. The ECC makes the pallet legs impact resistant when a moving fork tine hits the pallet leg. Moreover, the ECC prevents the pallet legs from filling up with water such as when the pallet is washed with water or left outside in the rain or other precipitation.

For tracking and other purposes, pallets sometimes incorporate electronics, such as global positioning system (GPS) electronics, radio-frequency identification (RFID) tags, and internet of things (IoT) tags. Such electronics can be prone to damage, even during routine use of the pallet. With this pallet design, these electronics can be safely housed in the legs of the pallet, and the unique configuration of the concrete and foam material found inside the legs can protect the electronics during impacts.

The legs include a unique chamber or cavity design in which the concrete material is filled and hardened. In one form, the cavities in the leg are shaped in a fashion similar to a wheel-hub or flower design. The cavities are shaped in a manner similar to the shape of a slice of pie or cake such that the hardened concrete forms a series of wedges. The remaining wedge-shaped cavities and hub cavity are filled with the foam insert. When impacted, the wedges of concrete in the leg distribute the load to one another in a fashion similar to an arch. The foam insert can help to further dampen the impact.

The system and techniques as described and illustrated herein concern a number of unique and inventive aspects. Some, but by no means all, of these unique aspects are summarized below.

Aspect 1 generally concerns a system.

Aspect 2 generally concerns the system of any previous aspect including a pallet.

Aspect 3 generally concerns the system of any previous aspect in which the pallet is made of plastic.

Aspect 4 generally concerns the system of any previous aspect including a deck.

Aspect 5 generally concerns the system of any previous aspect in which the deck includes a tray, a cap, and a frame sandwiched between the tray and the cap.

Aspect 6 generally concerns the system of any previous aspect including one or more leg-plank bridges.

Aspect 7 generally concerns the system of any previous aspect in which the leg-plank bridges are attached to the deck.

Aspect 8 generally concerns the system of any previous aspect in which the leg-plank bridges include one or more legs and a plank extending between the legs.

Aspect 9 generally concerns the system of any previous aspect in which the legs and the plank are integrally formed together as an integrated part.

Aspect 10 generally concerns the system of any previous aspect in which the leg-plank bridges are made of injection molded plastic.

Aspect 11 generally concerns the system of any previous aspect including the legs.

Aspect 12 generally concerns the system of any previous aspect in which the legs are made of plastic.

Aspect 13 generally concerns the system of any previous aspect in which the legs have an exterior made of plastic.

Aspect 14 generally concerns the system of any previous aspect in which the legs are at least partially filled with concrete.

Aspect 15 generally concerns the system of any previous aspect in which the legs have one or more walls that define one or more cavities.

Aspect 16 generally concerns the system of any previous aspect in which the cavities are filled with concrete.

Aspect 17 generally concerns the system of any previous aspect in which the concrete fills the cavities located on a lead end of the pallet.

Aspect 18 generally concerns the system of any previous aspect in which the remaining cavities are filled with foam.

Aspect 19 generally concerns the system of any previous aspect in which the concrete entirely fills the chambers to inhibit water infiltration.

Aspect 20 generally concerns the system of any previous aspect in which the foam entirely fills the chambers to inhibit water infiltration.

Aspect 21 generally concerns the system of any previous aspect in which the foam includes an insert received in the legs.

Aspect 22 generally concerns the system of any previous aspect in which the concrete inhibits damage to the legs by forks.

Aspect 23 generally concerns the system of any previous aspect in which the concrete is an Engineered Concrete Composite (ECC) material.

Aspect 24 generally concerns the system of any previous aspect in which the legs extend from the deck.

Aspect 25 generally concerns the system of any previous aspect in which the plank extends between the legs.

Aspect 26 generally concerns the system of any previous aspect in which the legs define one or more fork openings.

Aspect 27 generally concerns the system of any previous aspect in which the legs have a side filled with concrete.

Aspect 28 generally concerns the system of any previous aspect in which the legs have an exterior side filled with concrete and in interior side filled with foam.

Aspect 29 generally concerns the system of any previous aspect in which the legs include a rim wall, a hub located inside the rim wall, and one or more spoke walls extending in a radial direction from the hub to the rim wall.

Aspect 30 generally concerns the system of any previous aspect in which the hub defines a hub cavity.

Aspect 31 generally concerns the system of any previous aspect in which the rim wall, the hub, and the spoke walls define one or more spoke cavities.

Aspect 32 generally concerns the system of any previous aspect including the insert.

Aspect 33 generally concerns the system of any previous aspect in which the insert is made of foam.

Aspect 34 generally concerns the system of any previous aspect including a base.

Aspect 35 generally concerns the system of any previous aspect in which the insert includes the base.

Aspect 36 generally concerns the system of any previous aspect including a brace extending inside the plank.

Aspect 37 generally concerns the system of any previous aspect in which the brace has one or more ribs.

Aspect 38 generally concerns the system of any previous aspect in which the base defines one or more notches receiving the ribs of the brace.

Aspect 39 generally concerns the system of any previous aspect including a stem.

Aspect 40 generally concerns the system of any previous aspect in which the insert includes the stem.

Aspect 41 generally concerns the system of any previous aspect in which the stem extends from the base.

Aspect 42 generally concerns the system of any previous aspect including one or more petals.

Aspect 43 generally concerns the system of any previous aspect in which the insert includes the petals.

Aspect 44 generally concerns the system of any previous aspect in which the petals extend around the stem.

Aspect 45 generally concerns the system of any previous aspect in which the petals define spoke channels.

Aspect 46 generally concerns the system of any previous aspect in which the stem and petals define a hub cavity.

Aspect 47 generally concerns the system of any previous aspect in which the petals extend in an outer radial direction from the stem.

Aspect 48 generally concerns the system of any previous aspect in which the petals extend into the spoke cavities.

Aspect 49 generally concerns the system of any previous aspect in which the petals extend into all of the spoke cavities.

Aspect 50 generally concerns the system of any previous aspect including a foot.

Aspect 51 generally concerns the system of any previous aspect in which the insert includes the foot.

Aspect 52 generally concerns the system of any previous aspect in which the foot extends from the base.

Aspect 53 generally concerns the system of any previous aspect in which the foot extends opposite to the petals.

Aspect 54 generally concerns the system of any previous aspect in which the foot extends to the petals filled with the concrete.

Aspect 55 generally concerns the system of any previous aspect in which the spoke cavities are wedge shaped.

Aspect 56 generally concerns the system of any previous aspect in which the legs have a lead end.

Aspect 57 generally concerns the system of any previous aspect in which the spoke cavities at the lead end are filled with the concrete.

Aspect 58 generally concerns the system of any previous aspect in which the petals extend into the spoke cavities located opposite to the lead end.

Aspect 59 generally concerns the system of any previous aspect in which the stem extends into the hub cavity.

Aspect 60 generally concerns the system of any previous aspect in which the spoke walls have edges.

Aspect 61 generally concerns the system of any previous aspect in which the edges curve towards the hub to define one or more depressions.

Aspect 62 generally concerns the system of any previous aspect in which the depressions are filled with the concrete.

Aspect 63 generally concerns the system of any previous aspect in which the stem and the petal have ends that extend into one of the depressions.

Aspect 64 generally concerns the system of any previous aspect in which the base is located into one of the depressions.

Aspect 65 generally concerns the system of any previous aspect in which the legs have an asymmetric shape.

Aspect 66 generally concerns the system of any previous aspect in which the legs have a symmetric shape.

Aspect 67 generally concerns the system of any previous aspect including the plank.

Aspect 68 generally concerns the system of any previous aspect in which the leg-plank bridges include an outer leg-plank bridge positioned along a lateral side of the pallet.

Aspect 69 generally concerns the system of any previous aspect in which the leg-plank bridges include an inner leg-plank bridge extending through the middle of the pallet.

Aspect 70 generally concerns a method of manufacturing the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
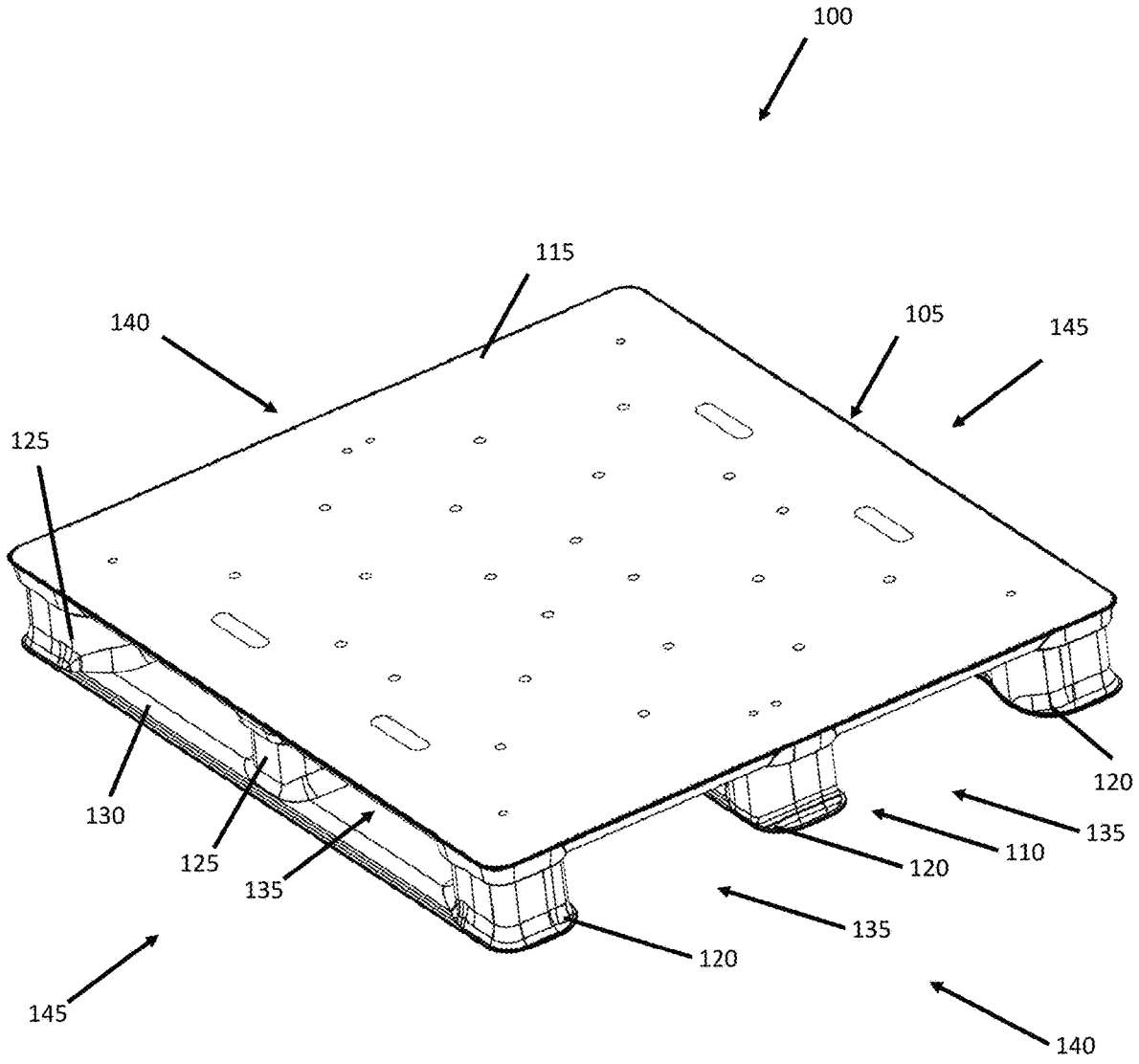
FIG. 1 is a top perspective view of a pallet according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

Figure 2:
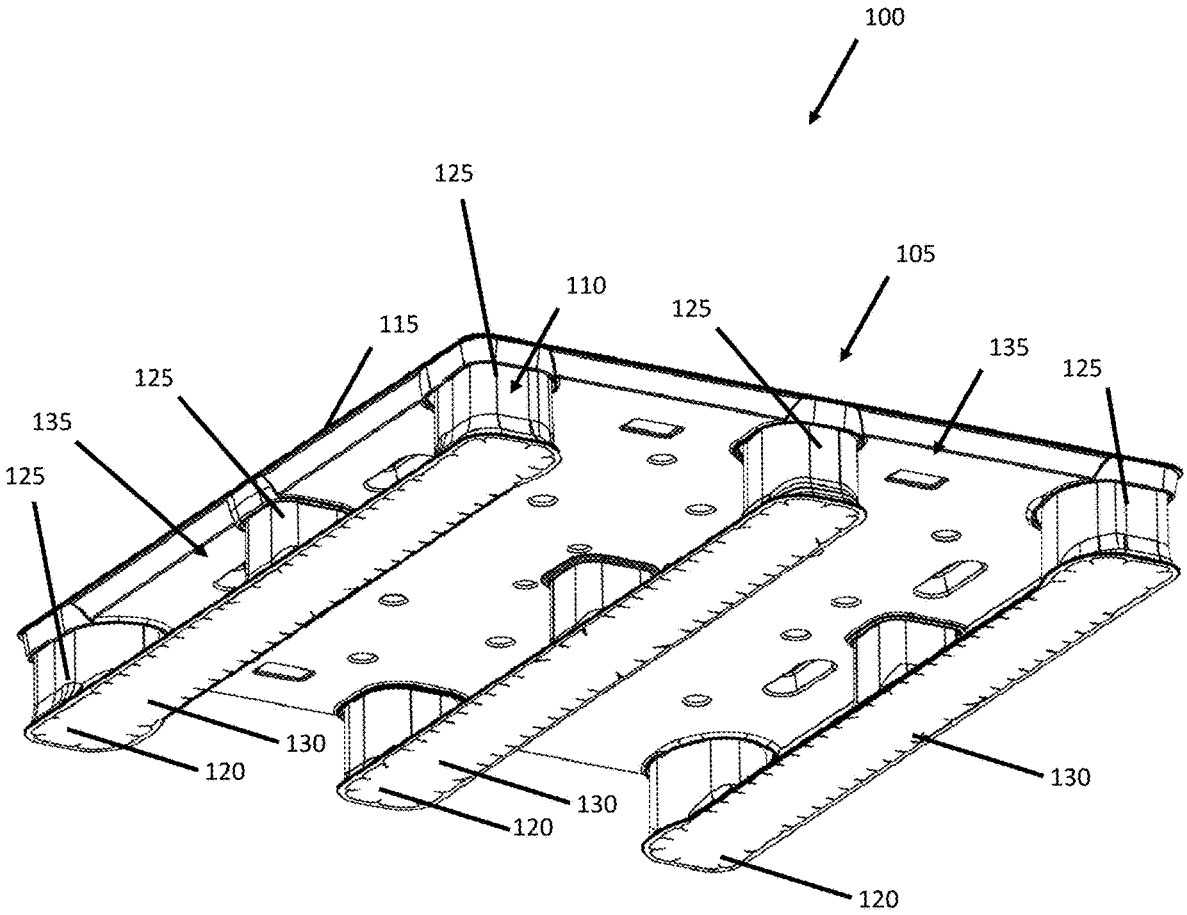
FIG. 2 is a bottom perspective view of the FIG. 1 pallet.

A unique pallet design has been developed that is lightweight and inexpensive, and yet at the same time, the pallet is designed to minimize damage during routine use. FIG. 1 is a top perspective view of a pallet 100 according to one example, and FIG. 2 is a bottom perspective view of the pallet 100. As should be recognized, the pallet 100 is a portable platform or other structure on which goods or other items can be stacked, stored, and/or transported. The pallet 100 includes a deck 105 and a spacer structure 110 connected to the deck 105. Typically, but not always, items and other objects are stacked on the deck 105. The spacer structure 110 raises the deck 105 off the floor or ground so that the pallet 100 can be for instance moved by a forklift or pallet truck. The spacer structure 110 is attached to the deck 105 such as via fasteners, adhesives, welding and/or in other manners. As will be explained below, the deck 105 in one variation is secured to the spacer structure 110 via ultrasonic welding. The exterior of the pallet 100 in one form is generally made of plastic. As will be explained below, the interior of the pallet 100 is made from a variety of materials in different areas to form a composite that provides requisite strength and durability while at the same time is lightweight. In one form, the weight and cost of the pallet 100 is comparable to a traditional wooden pallet.

In the depicted example, the deck 105 includes a load deck 115. The load deck 115 in the illustrated example is solid and generally flat, but the load deck 115 in other examples can be shaped differently. For instance, the load deck 115 can include spaced apart slats (i.e., have an open deck design). The surface of the load deck 115 can include printed images and/or non-skid textures to facilitate packing and handling. The exterior of the load deck 115 in one form is made of plastic. For instance, parts of the load deck 115 can be made from injection molded and/or thermo-formed plastics.

The spacer structure 110 in the illustrated example includes one or more leg-plank bridges 120. Each of the leg-plank bridges 120 include one or more blocks or legs 125 and a plank 130. In the leg-plank bridges 120, the legs 125 of the leg-plank bridges 120 are integrally formed with the plank 130 to form a single component. The exterior of the legs 125 in one form is made of plastic. For instance, the legs 125 and plank 130 of each leg-plank bridge 120 can be formed together at the same time from injection molded and/or thermo-formed plastics.

The leg-plank bridges 120 define one or more fork openings 135 configured to receive the forks of a forklift truck, robotic handling equipment, pallet truck, and/or other types of equipment. The pallet 100 in the depicted example is a four-way type pallet in which the fork openings 135 are located on all four sides of the pallet 100. In other examples, the pallet 100 can be configured as a two-way pallet with fork openings 135 located on two opposite ends of the pallet 100.

The pallet 100 has opposing, lead sides 140 located on opposite sides of the pallet 100, and the pallet 100 has opposing, lateral sides 145 located on opposite sides of the pallet 100. The plank 130 of each leg-plank bridge 120 extend across the lateral sides 145 of the pallet 100. In other words, the planks 130 of the leg-plank bridges 120 extend longitudinally between the lead sides 140. With such a configuration, the forks of the forklift truck or other pallet handling device are more likely to be inserted through the fork openings 135 located on the lead sides 140, because there is less of a chance of the forks hitting the planks 130 when inserted into the fork openings 135. Consequently, the legs 125 located on the lead sides 140 are more prone to damage. The sides of the legs 125 facing the lead sides 140 are configured to be durable so as to resist such damage, and at the same time, the legs 125 are designed to be lightweight.

Figure 3:
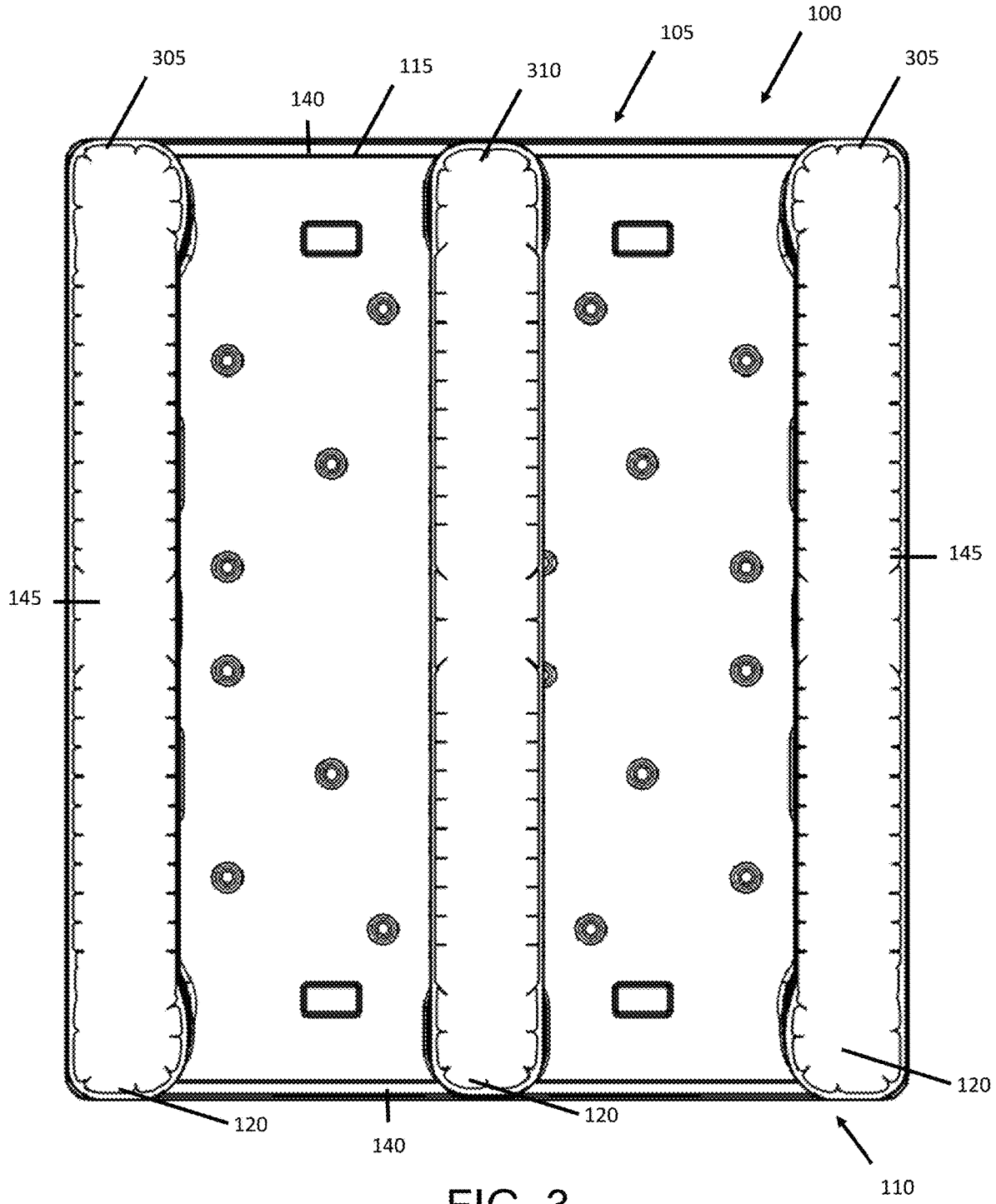
FIG. 3 is a bottom view of the FIG. 1 pallet.

As illustrated in FIG. 3, each of the leg-plank bridges 120 of the pallet 100 includes one or more outer leg-plank bridges 305 and an inner leg-plank bridge 310 disposed between the outer leg-plank bridges 305. The outer leg-plank bridges 305 and inner leg-plank bridge 310 have a generally similar construction, but since the inner leg-plank bridge 310 is located in the middle such that the lateral sides of the inner leg-plank bridge 310 are less prone to lateral impacts, the inner leg-plank bridge 310 has a slightly different construction as compared to the outer leg-plank bridges 305. As can be seen, the outer leg-plank bridges 305 extend along the lateral sides 145 of the pallet 100, and the outer leg-plank bridges 305 and inner leg-plank bridge 310 generally extend in a parallel manner.

Figure 4:
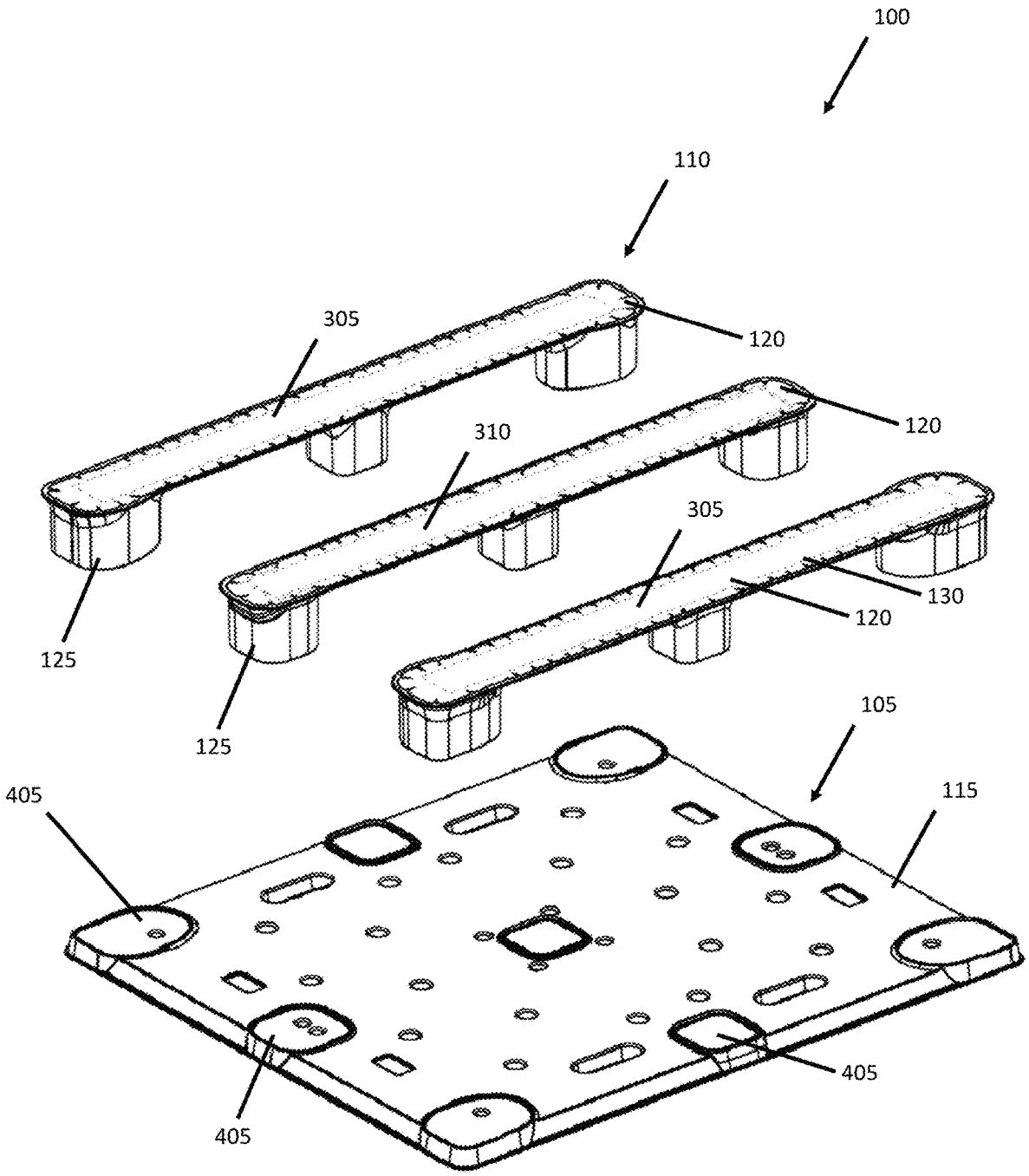
FIG. 4 is an exploded view of the FIG. 1 pallet.
Figure 5:
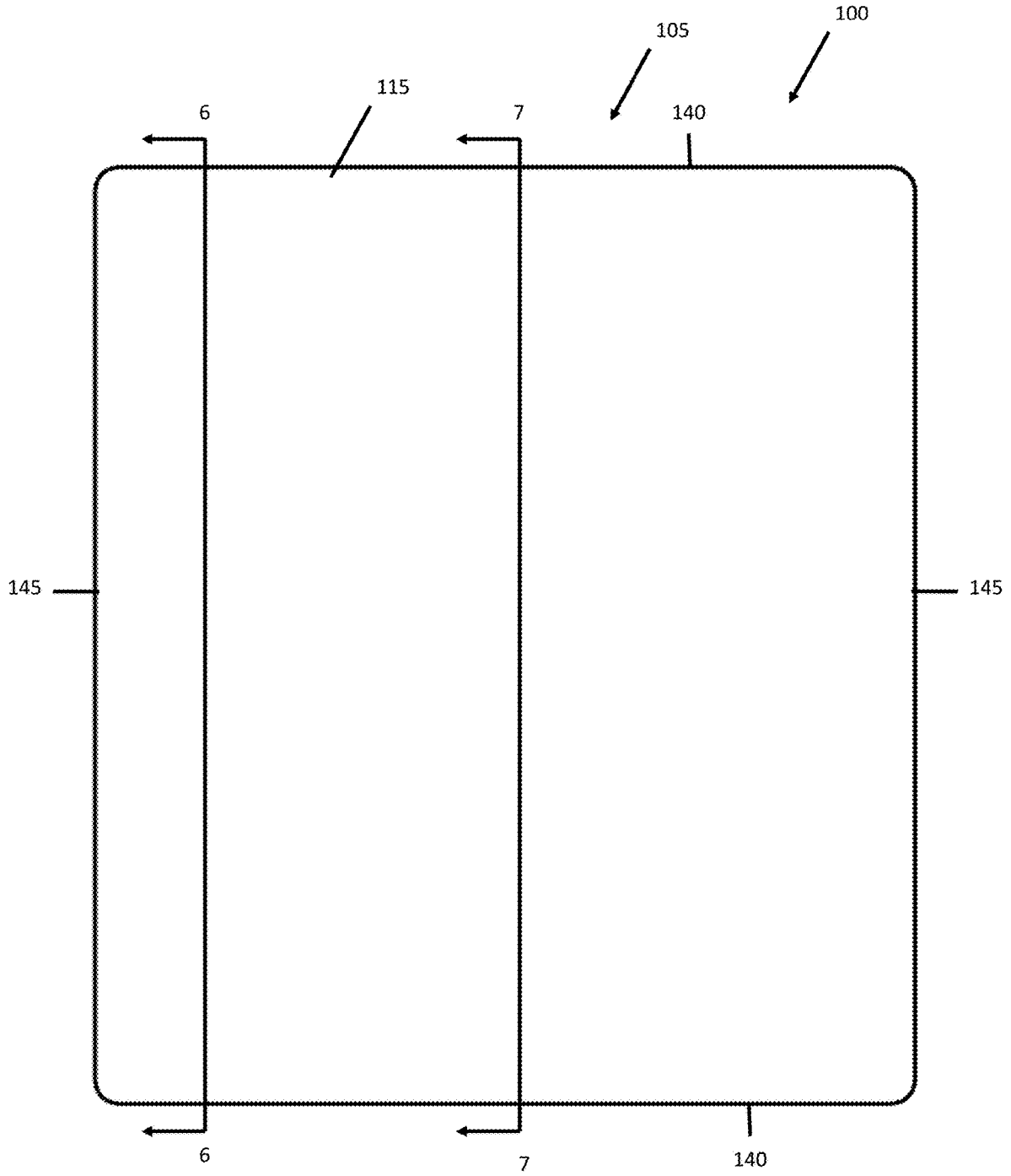
FIG. 5 is a top view of the FIG. 1 pallet.
Figure 6:
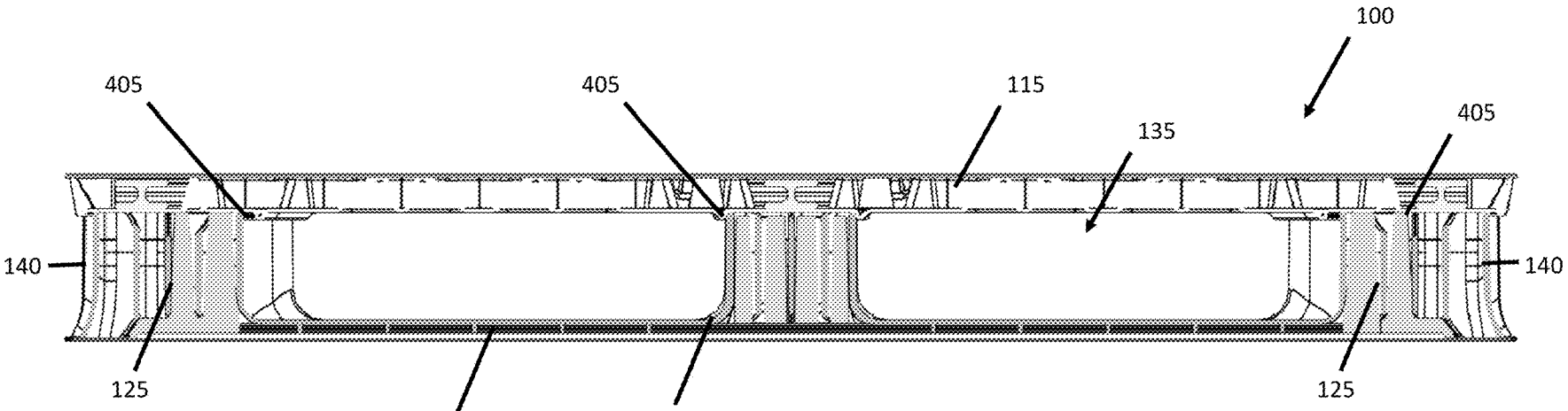
FIG. 6 is a cross-sectional view of the FIG. 1 pallet as taken along line 6-6 in FIG. 5.
Figure 7:
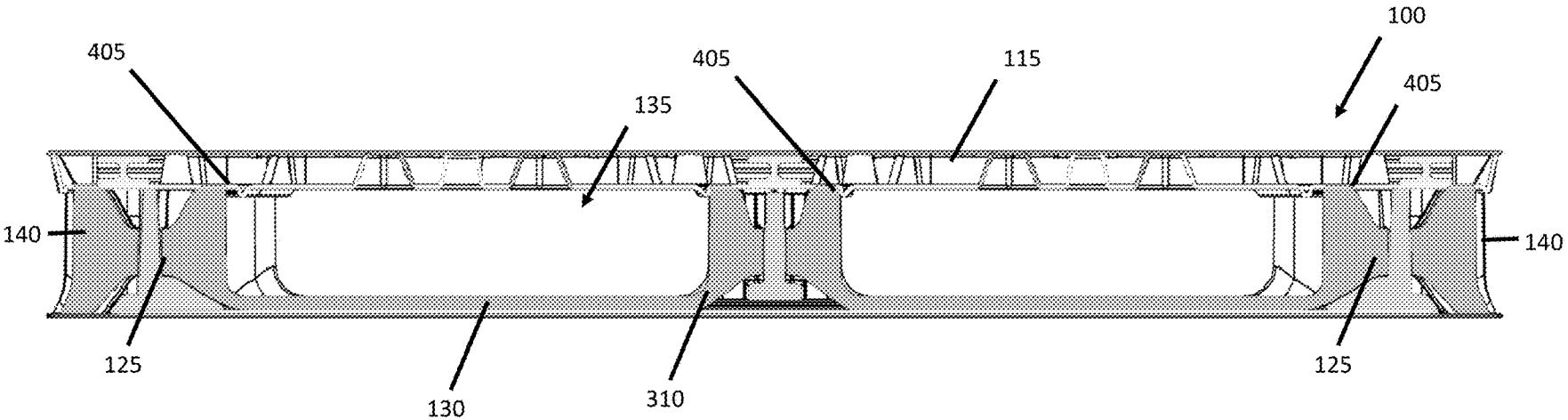
FIG. 7 is a cross-sectional view of the FIG. 1 pallet as taken along line 7-7 in FIG. 5.

FIG. 4 is an exploded view of the FIG. 1 pallet 100, and FIG. 5 is a top view of the FIG. 1 pallet 100. FIG. 6 is a cross-sectional view of the pallet 100 as taken along line 6-6 in FIG. 5, and FIG. 7 is a cross-sectional view of the pallet 100 as taken along line 7-7 in FIG. 5. The load deck 115 has one or more sockets 405 in which the legs 125 of the leg-plank bridges 120 are secured. As shown in FIGS. 6 and 7, the sockets 405 are in the form of ridges that generally circumscribe the shape of the corresponding leg 125 that is inserted into the socket 405. The exteriors of the load deck 115 and the legs 125 in one version are made of plastic, and the legs 125 are ultrasonically welded to the sockets 405. The legs 125 can be secured to the load deck 115 in other ways such as via adhesives and/or fasteners.

Figure 8:
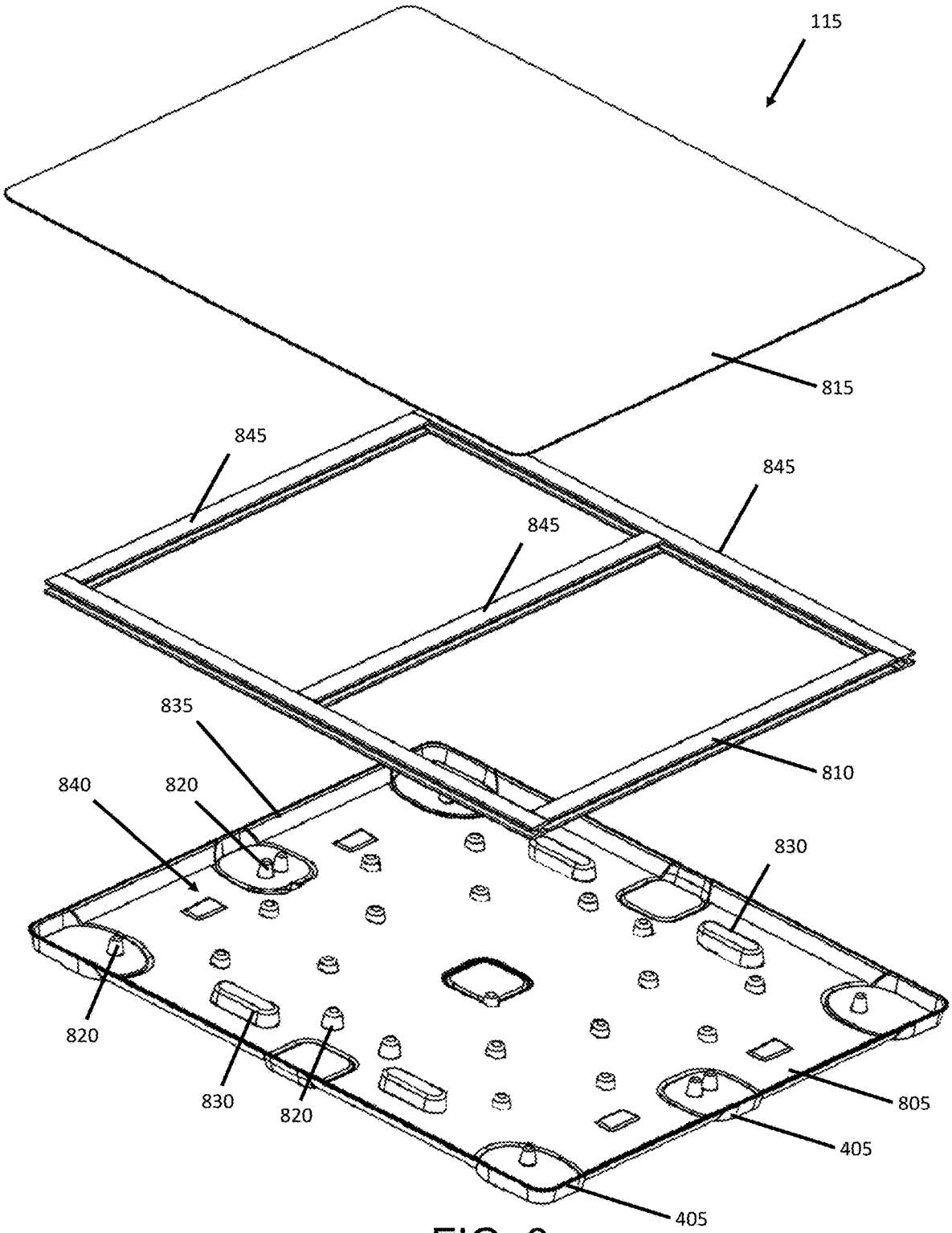
FIG. 8 is an exploded view of a load deck in the FIG. 1 pallet.
Figure 9:
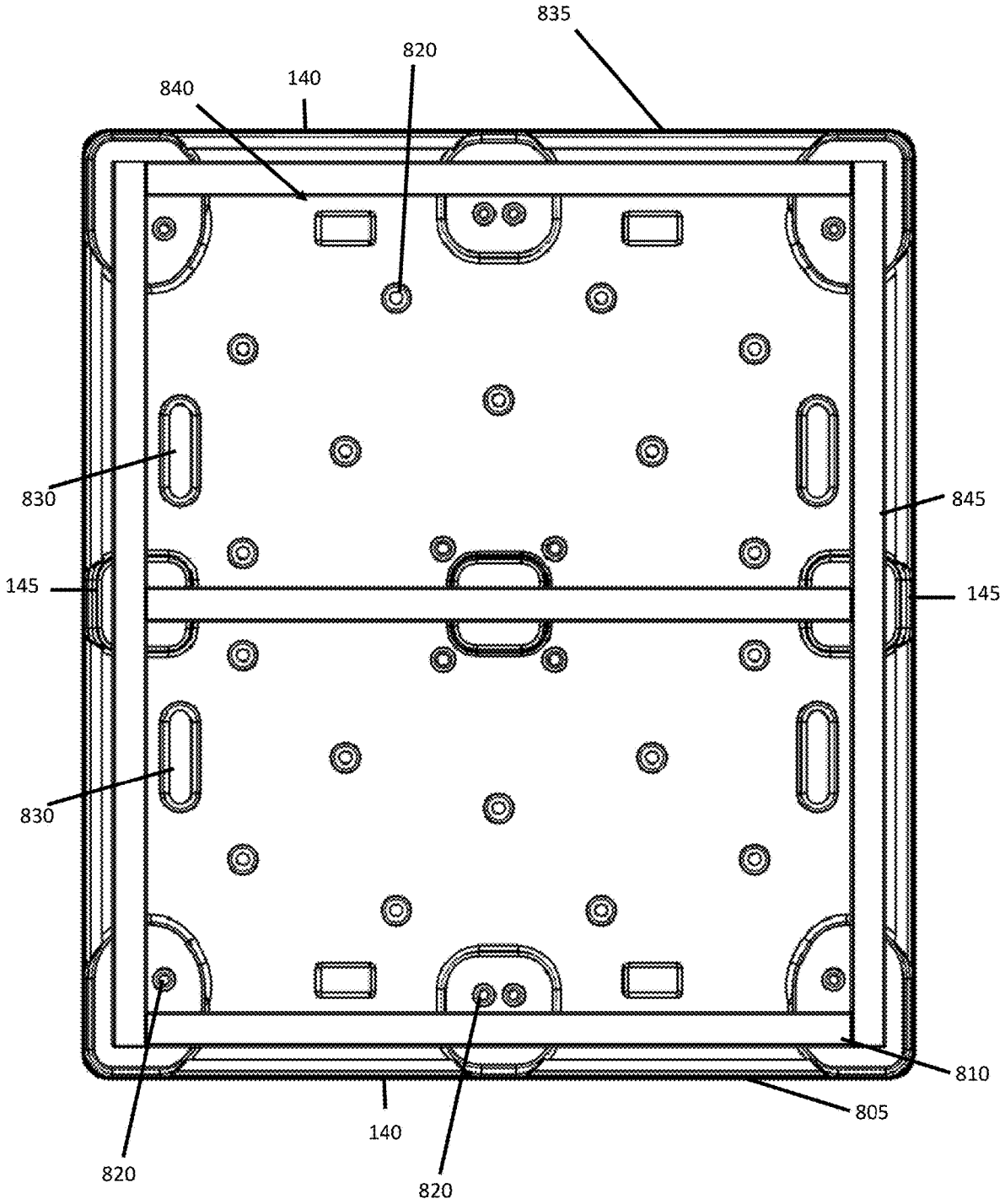
FIG. 9 is a top view of the FIG. 8 load deck with a deck cap removed.

FIG. 8 is an exploded view of the load deck 115 for the pallet 100. As shown, the load deck 115 includes a tray 805, a frame 810, and a deck cap 815. For the load deck 115, items or other objects are typically packed or otherwise stacked on the deck cap 815. FIG. 9 shows a top view of the load deck 115 with the deck cap 815 removed. The tray 805 and frame 810 provide structural support and stiffness to the deck cap 815. The deck cap 815 is secured to the tray 805 with the frame 810 sandwiched inside. In one form, the tray 805 is ultrasonically welded to the deck cap 815 to form a watertight seal, but the tray 805 and deck cap 815 can be secured in other manners such as via adhesives and/or fasteners.

Looking at FIGS. 8 and 9, the tray 805 in one form includes one or more weld points 820 where the tray 805 is welded to the deck cap 815. The tray 805 has one or more grip cups 830 where an individual is able to grab the pallet 100. Around the periphery, the tray 805 has a peripheral wall 835 that defines a deck cavity 840. In one form, the deck cap 815 is ultrasonically welded or otherwise secured to the tray 805 at the peripheral wall 835. Other than the frame 810, the deck cavity 840 formed between the tray 805 and deck cap 815 is generally empty in one version to make the pallet 100 lightweight. In other versions, the deck cavity 840 between the tray 805 and deck cap 815 is filled with a filler material, such as an Engineered Cementous Composite (ECC) material, to provide additional strength and durability. In one example, the various structures of the tray 805, such as the weld points 820 and grip cups 830, are created via thermoforming a sheet of plastic, and in another example, these structures of the tray 805 are created via injection molding.

The frame 810 has one or more beams 845 arranged in a grid pattern inside the deck cavity 840. The beams 845 are made from fiber reinforced material or other composite material such as fiberglass or carbon fiber materials. In one particular form, the beams 845 have an I-beam shape. To enhance the strength of the load deck 115, the beams 845 extend between sockets 405 where legs 125 are secured.

Figure 10:
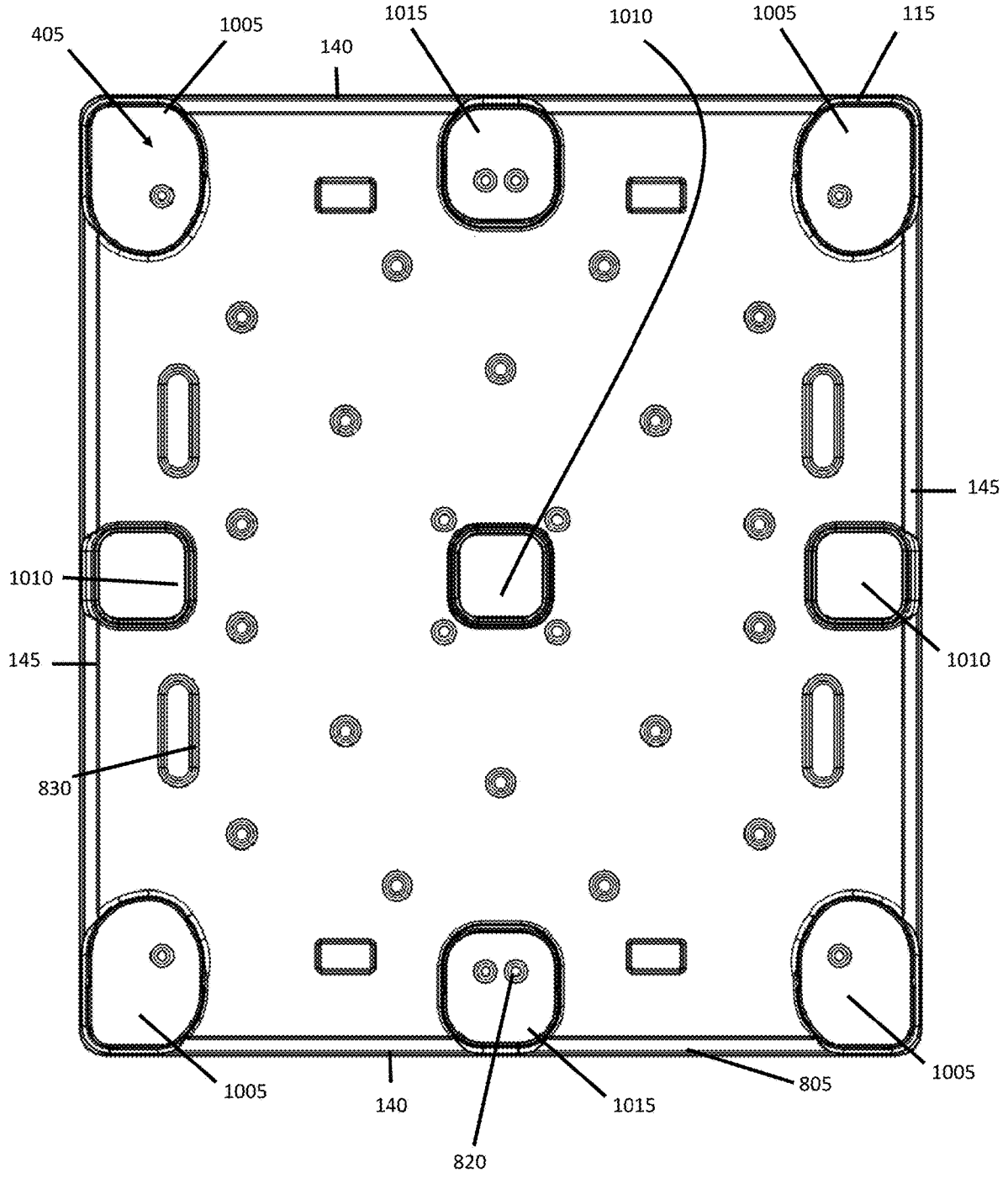
FIG. 10 is a bottom view of the FIG. 8 load deck.

Turning to FIG. 10, the sockets 405 include one or more corner sockets 1005, middle sockets 1010, and end sockets 1015 that are configured to secure to the differently shaped legs 125 of the outer leg-plank bridges 305 and inner leg-plank bridge 310. The sockets 405 are located on the underside of the load deck 115. That is, the sockets 405 are located on the tray 805 at the side opposite to where the deck cap 815 is secured to the tray 805. As can be seen, the corner sockets 1005 are located at the underside corners of the load deck 115 where the lead sides 140 and lateral sides 145 meet. The middle sockets 1010 are positioned along the lateral sides 145 between the corner sockets 1005 and in the middle of the tray 805. The end sockets 1015 of the tray 805 are located between the corner sockets 1005 along the lead sides 140.

Figure 11:
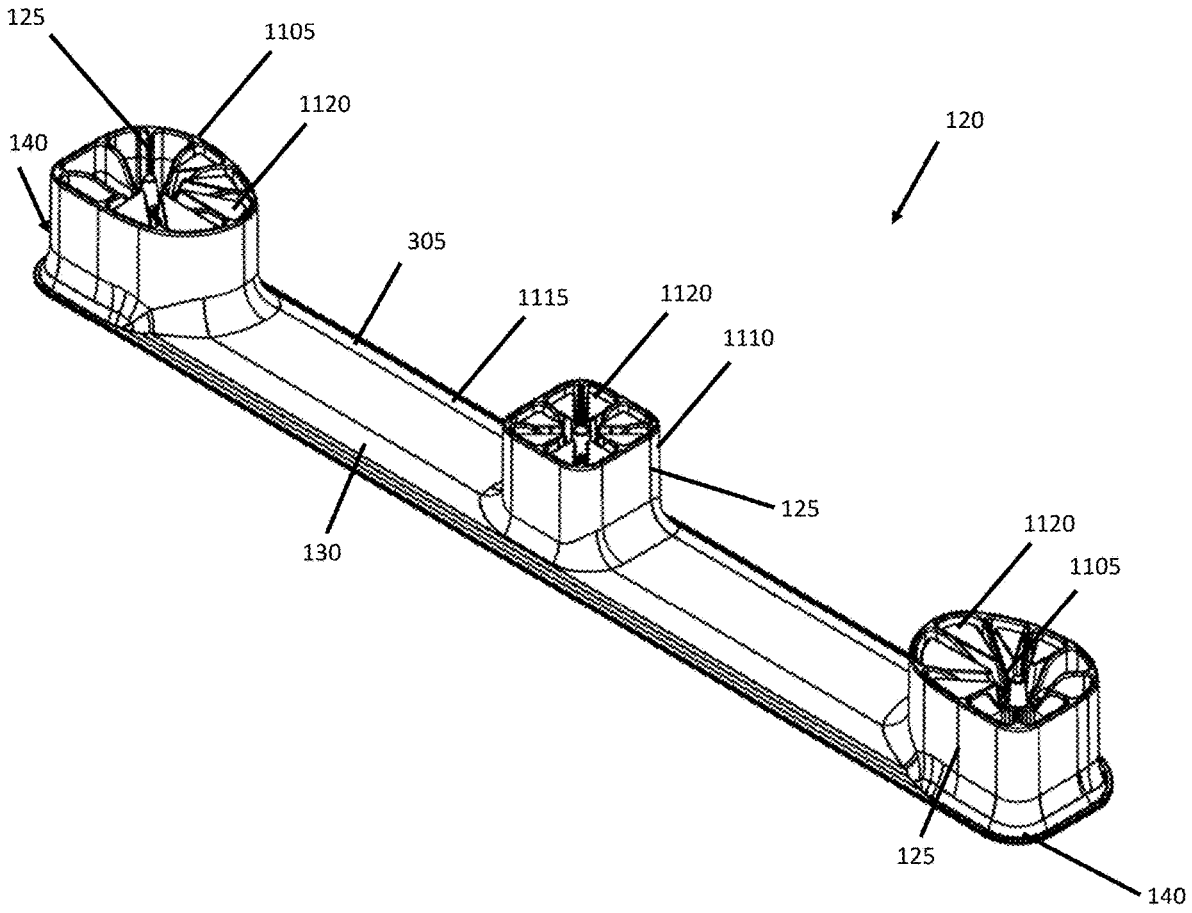
FIG. 11 is a perspective view of an outer leg-plank bridge found in the FIG. 1 pallet.
Figure 12:
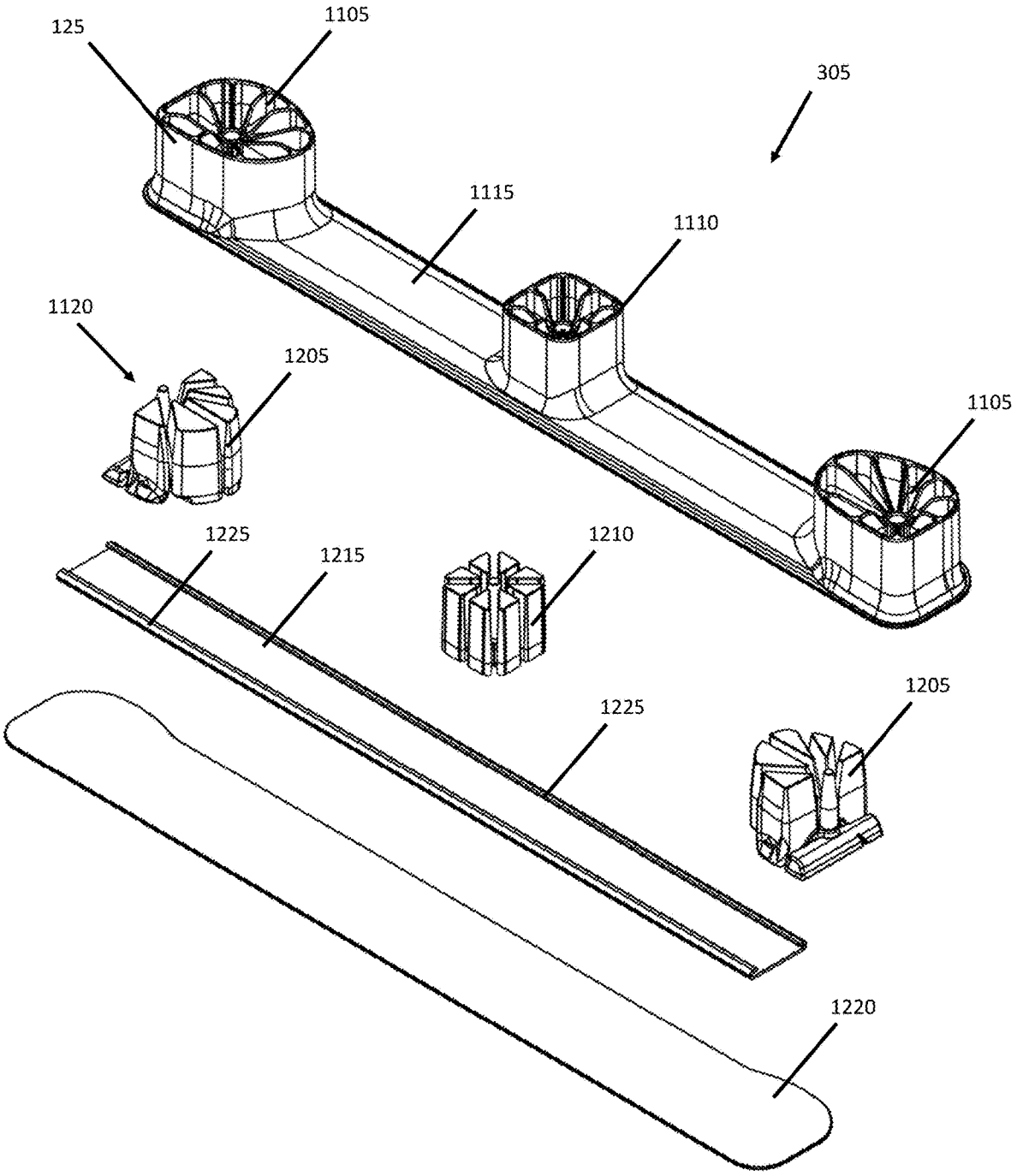
FIG. 12 is a top exploded view of the FIG. 11 outer leg-plank bridge.
Figure 13:
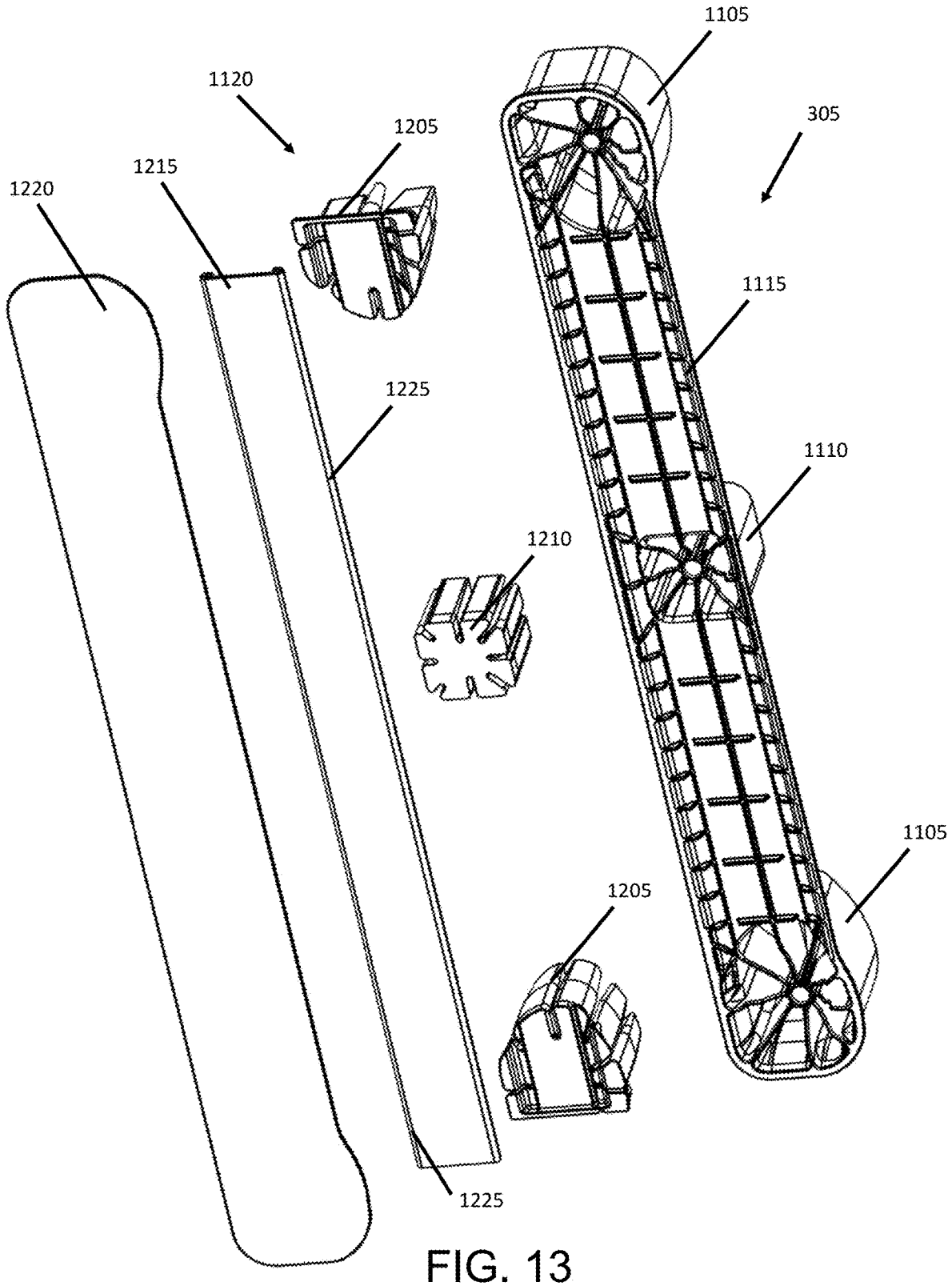
FIG. 13 is a bottom exploded view of the FIG. 11 outer leg-plank bridge.

The outer leg-plank bridges 305 of the pallet 100 are designed to be interchangeable such that the outer leg-plank bridges 305 can be used on either lateral side 145 of the pallet 100. Referring to FIGS. 11, 12, and 13, the outer leg-plank bridges 305 each include one or more corner legs 1105, a middle leg 1110, and an outer bridge body 1115 that are integrally formed together as a single component. For instance, the corner legs 1105, middle leg 1110, and outer bridge body 1115 of the outer leg-plank bridges 305 in one version are created via injection molding plastic. The corner legs 1105 are located at opposite ends of the of the load deck 115. In particular, the corner legs 1105 are located at the lead sides 140 of the pallet 100 when assembled. As alluded to before, the corner legs 1105 are constructed to be lightweight, strong, and durable so as to resist damage from repeated fork and other types of impacts during routine use. The middle leg 1110 is sandwiched or located between the corner legs 1105 along the outer bridge body 1115. Looking again at FIGS. 10 and 11, the corner legs 1105 are configured to be welded or otherwise attached to the corner sockets 1005 of the tray 805, and for each outer leg-plank bridge 305, the middle leg 1110 is configured to secure to the middle socket 1010 of the load deck 115.

To reduce the weight of the outer leg-plank bridges 305 and absorb shock from impacts, the outer leg-plank bridges 305 include one or more inserts 1120 that are received inside the legs 125. The inserts 1120 are made of a plastic foam material such as expanded polystyrene foam. Looking at FIG. 12, the inserts 1120 in the outer leg-plank bridges 305 include one or more corner inserts 1205 and a middle insert 1210.

The outer leg-plank bridges 305 further include a brace 1215 and an outer bridge cap 1220. The brace 1215 is configured to stiffen the outer leg-plank bridge 305. The brace 1215 in the illustrated example is in the form of a c-channel type brace that is made of a fiber reinforced composite material, such as fiberglass and carbon fiber materials, and in other examples, the brace 1215 is made from metal, such as aluminum and steel. The longitudinal sides of the brace 1215 are bent or folded to form ribs 1225 that further stiffen the brace 1215. The outer bridge cap 1220 is configured to enclose and/or retain the inserts 1120 and brace 1215 inside the outer leg-plank bridges 305. The outer bridge cap 1220 in one version is welded to the periphery of the outer bridge body 1115 via ultrasonic welding to provide a watertight seal, and in other versions, the outer bridge body 1115 can be secured in other ways such as via adhesives and fasteners.

The ends of the corner legs 1105 facing the lead sides 140 are generally not filled with the corner inserts 1205, but are filled with a hardened filler material, like concrete, so as to make the corner legs 1105 stronger and more durable to resist fork and other impacts. The middle leg 1110 is almost completely filled with the middle insert 1210. The ends of the outer bridge cap 1220 are bowed or curved so as to match the shape of the corner legs 1105. The corner legs 1105 in the illustrated example have an asymmetric shape. In particular, the corner legs 1105 of the outer leg-plank bridges 305 are bowed towards the fork openings 135 so as to guide the forks during insertion so as to protect the middle leg 1110 which is completely filled with the middle insert 1210.

Figure 14:
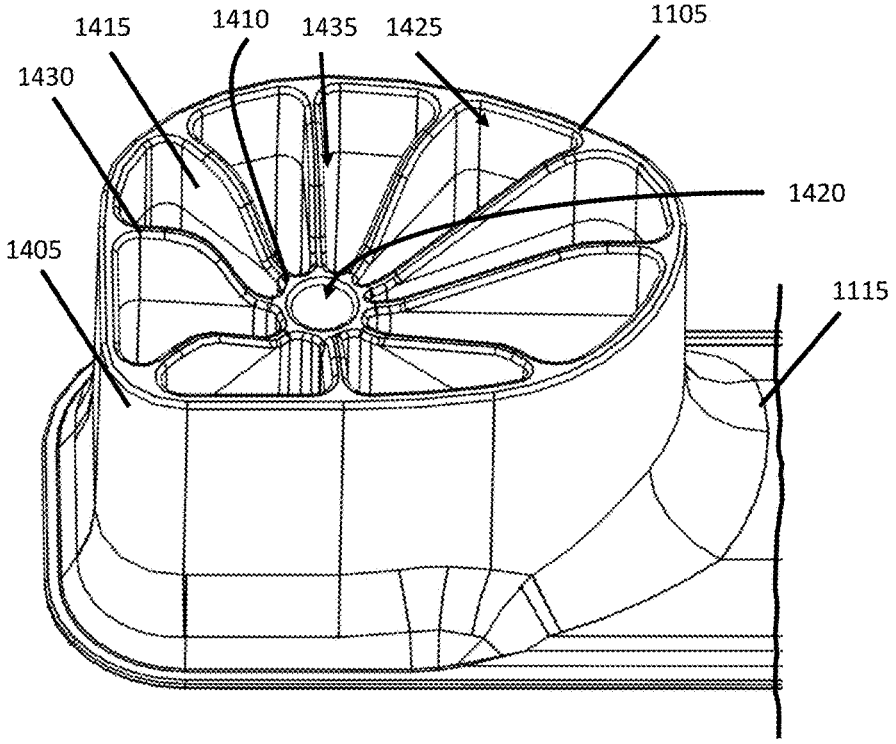
FIG. 14 is a top perspective view of a corner leg of the FIG. 11 outer leg-plank bridge.

As depicted in FIG. 14, the corner legs 1105 have a rim wall 1405, a hub 1410, and one or more spoke walls 1415 that extend from the rim wall 1405 to the hub 1410. The hub 1410 defines a hub cavity 1420 configured to receive part of the corner insert 1205. One or more spoke cavities 1425 radially extend from the hub 1410 to the rim wall 1405, and the spoke cavities 1425 are defined by the rim wall 1405, hub 1410, and spoke walls 1415. The hub cavity 1420 and spoke cavities 1425 are arranged in a fashion similar to a distorted wheel, flower, or pie. This arrangement helps to direct the impact forces radially inward which in turn strengthens the corner legs 1105.

The spoke walls 1415 have one or more edges 1430. The edges 1430 curve towards the hub 1410 to define depressions 1435 at opposite ends of the corner legs 1105. In one form, the depressions 1435 are configured to be filled with a portion of the corner inserts 1205 and filler material.

Figure 15:
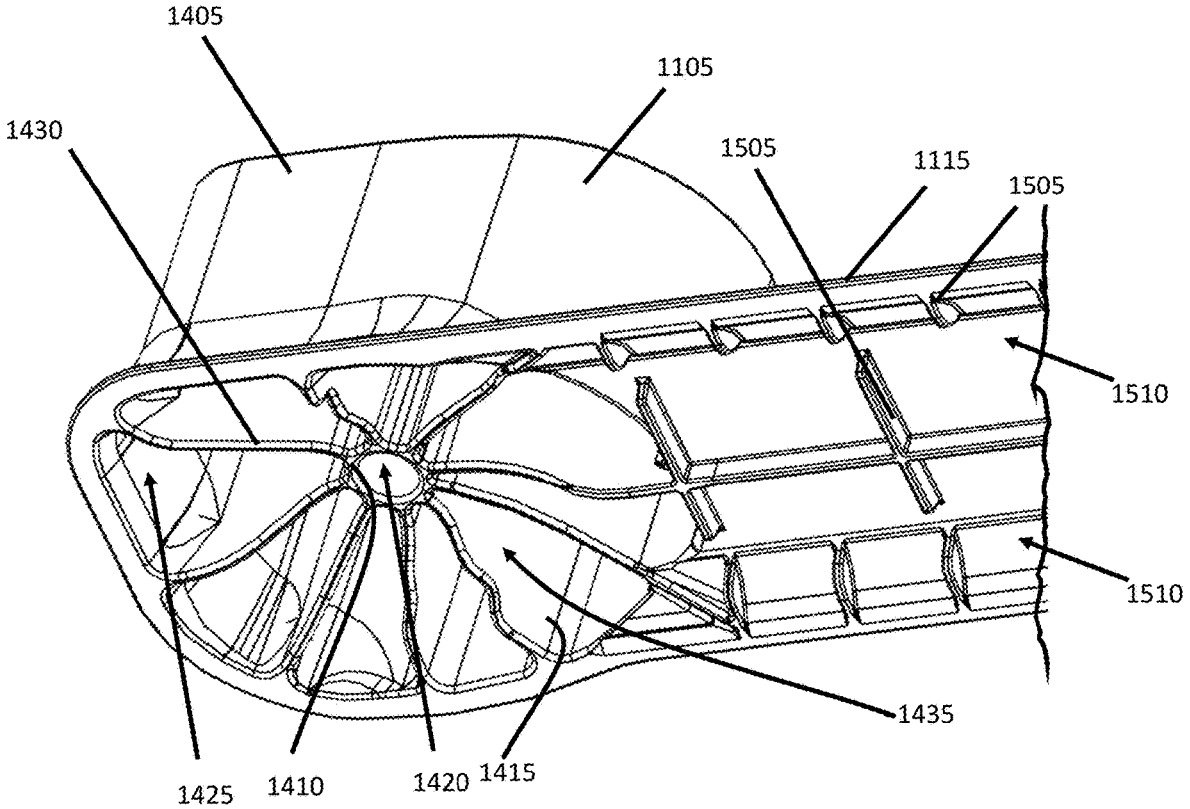
FIG. 15 is a bottom perspective view of the FIG. 14 corner leg.
Figure 16:
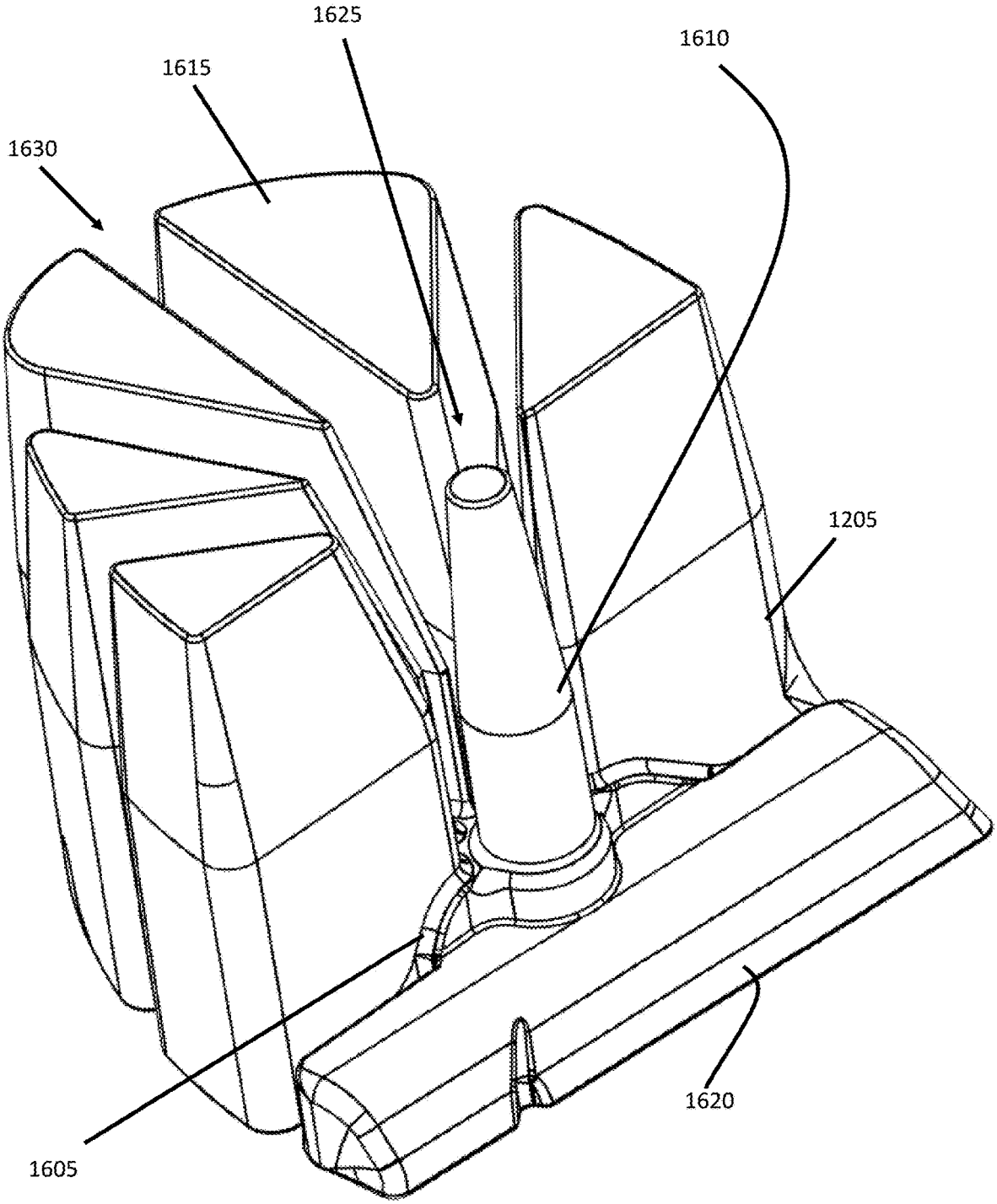
FIG. 16 is a front perspective view of a corner insert of the FIG. 11 outer leg-plank bridge.
Figure 17:
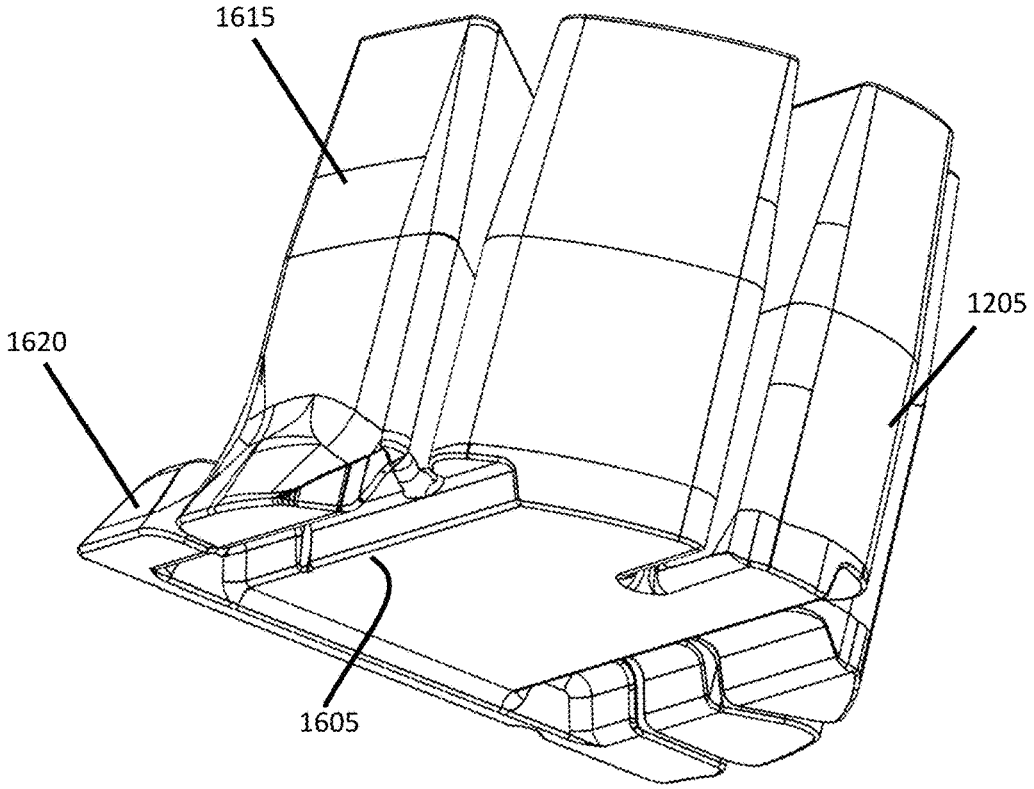
FIG. 17 is a bottom perspective view of the FIG. 16 corner insert.
Figure 18:
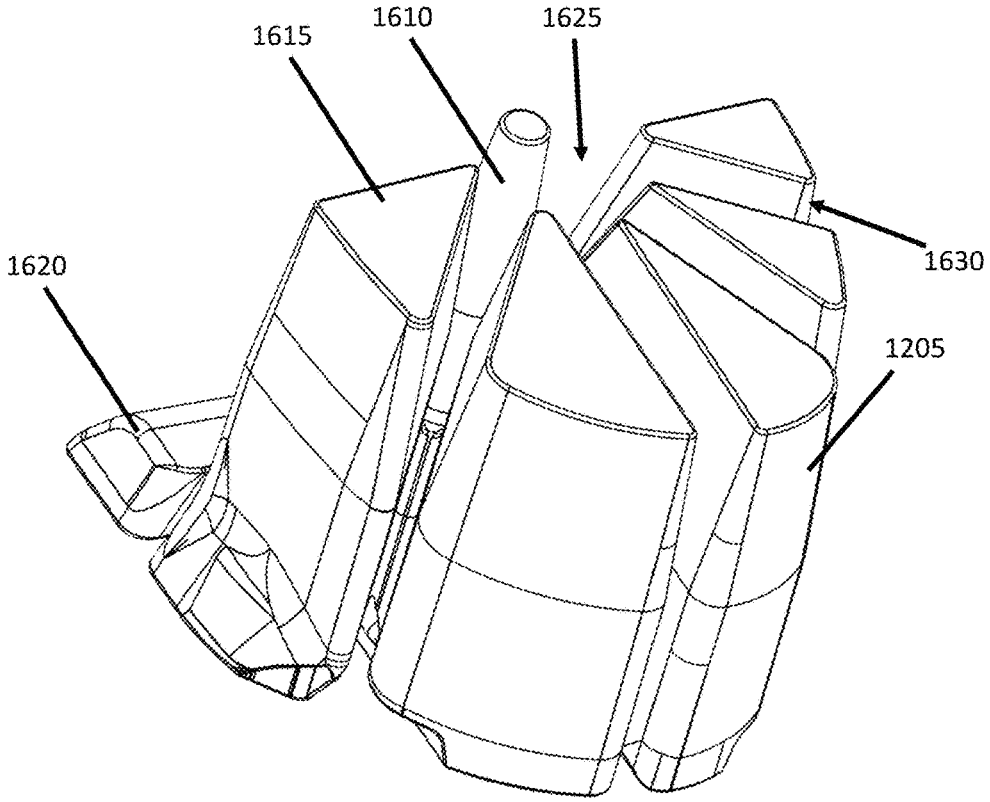
FIG. 18 is a rear perspective view of the FIG. 16 corner insert.
Figure 19:
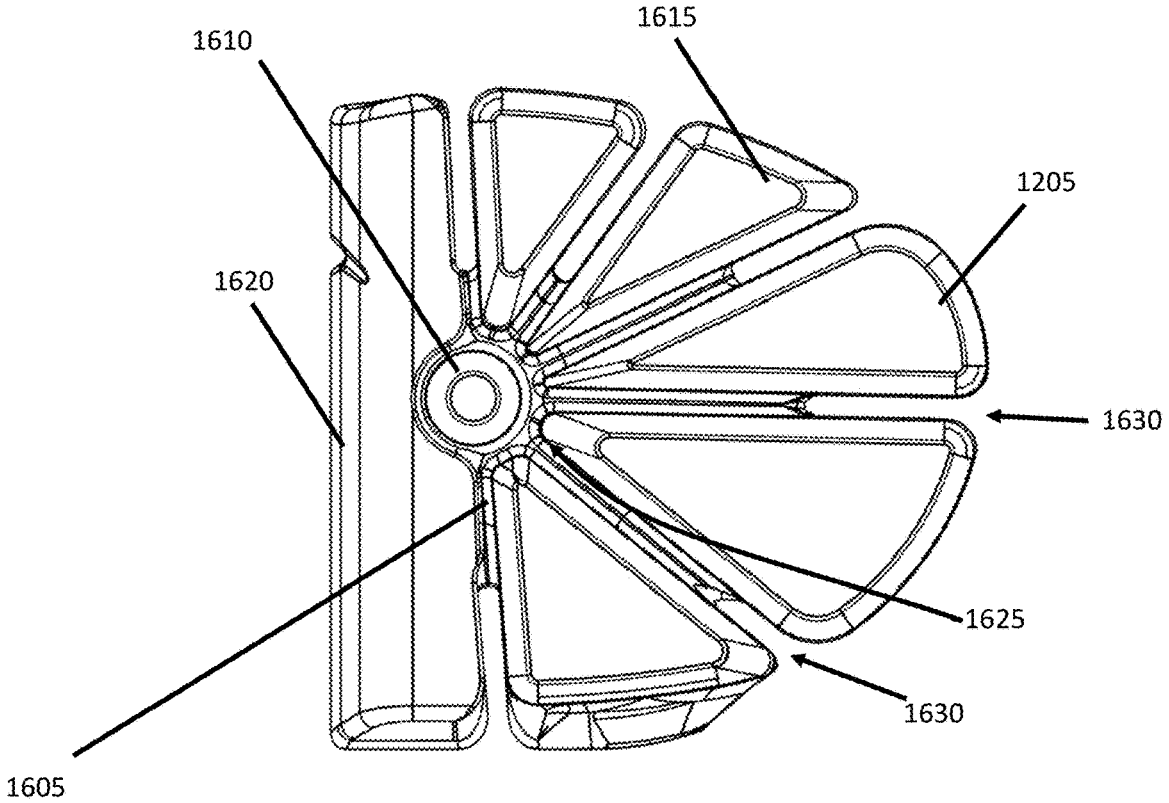
FIG. 19 is a top view of the FIG. 16 corner insert.

As shown in FIG. 15, the outer bridge body 1115 of the outer leg-plank bridges 305 has a series of one or more ribs 1505 that strengthen the outer bridge body 1115. The ribs 1505 define one or more brace channels 1510. The brace channels 1510 are configured to receive the folded longitudinal ribs 1225 of the brace 1215.

Looking at FIGS. 16, 17, 18, and 19, the corner inserts 1205 have a base 1605, a stem 1610, one or more petals 1615, and a foot 1620. The stem 1610 extends from the base 1605, and the stem 1610 is configured to be received in the hub cavity 1420. In one form, the end of the stem 1610 has a frustoconical shape. The petals 1615 radially extend around part of the stem 1610 to fill some of the spoke cavities 1425 that face the interior of the pallet 100. The foot 1620 extends from the base 1605 at a location opposite the petals 1615. The ends of the stem 1610 and petals 1615 generally have the same height.

A hub channel 1625 is defined between the stem 1610 and petals 1615 to separate the stem 1610 from the petals 1615. The hub channel 1625 is adapted to receive the hub 1410. The petals 1615 define one or more spoke channels 1630 that receive the spoke walls 1415 of the corner legs 1105 when the corner inserts 1205 are inserted into the corner legs 1105.

Figure 20:
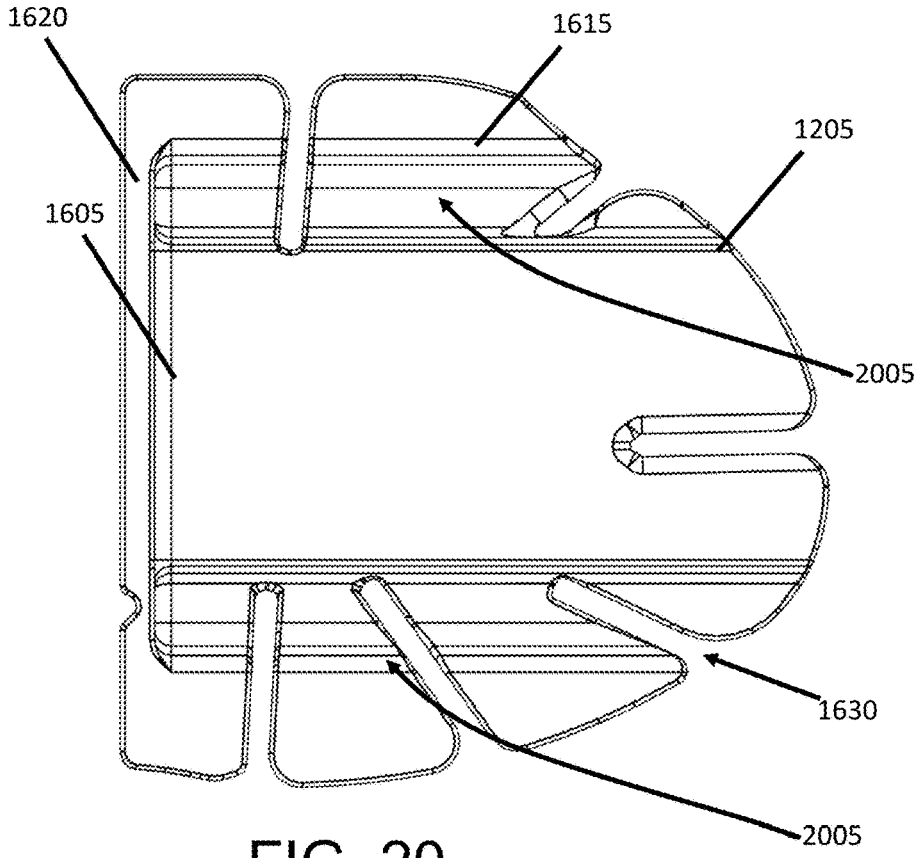
FIG. 20 is a bottom view of the FIG. 16 corner insert.
Figure 21:
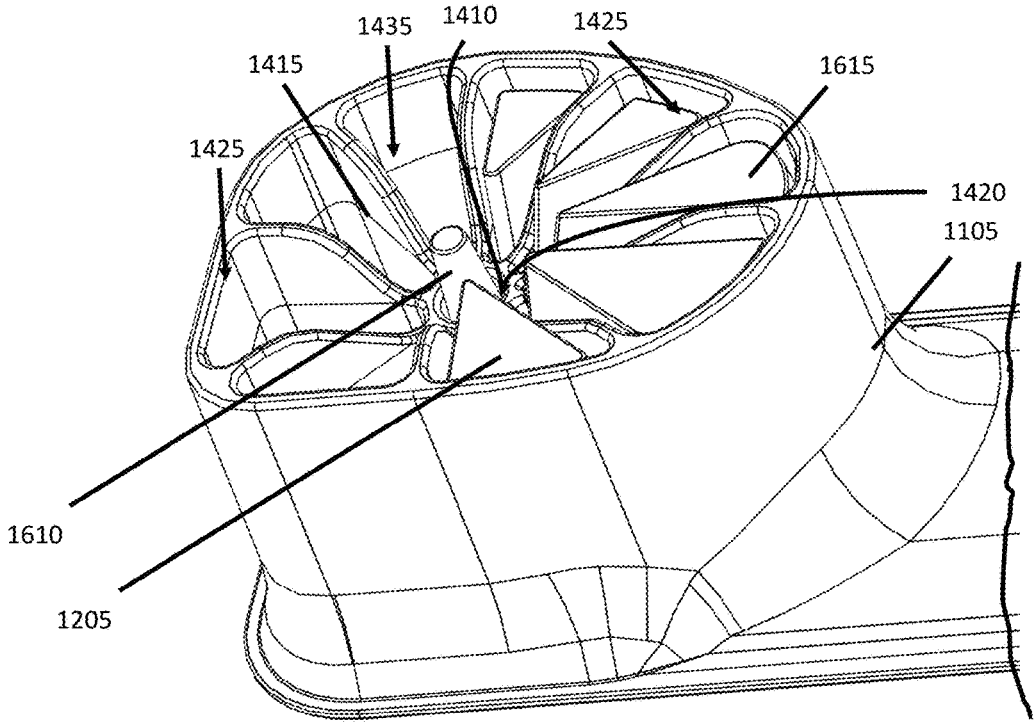
FIG. 21 is a side perspective view of the corner leg.
Figure 22:
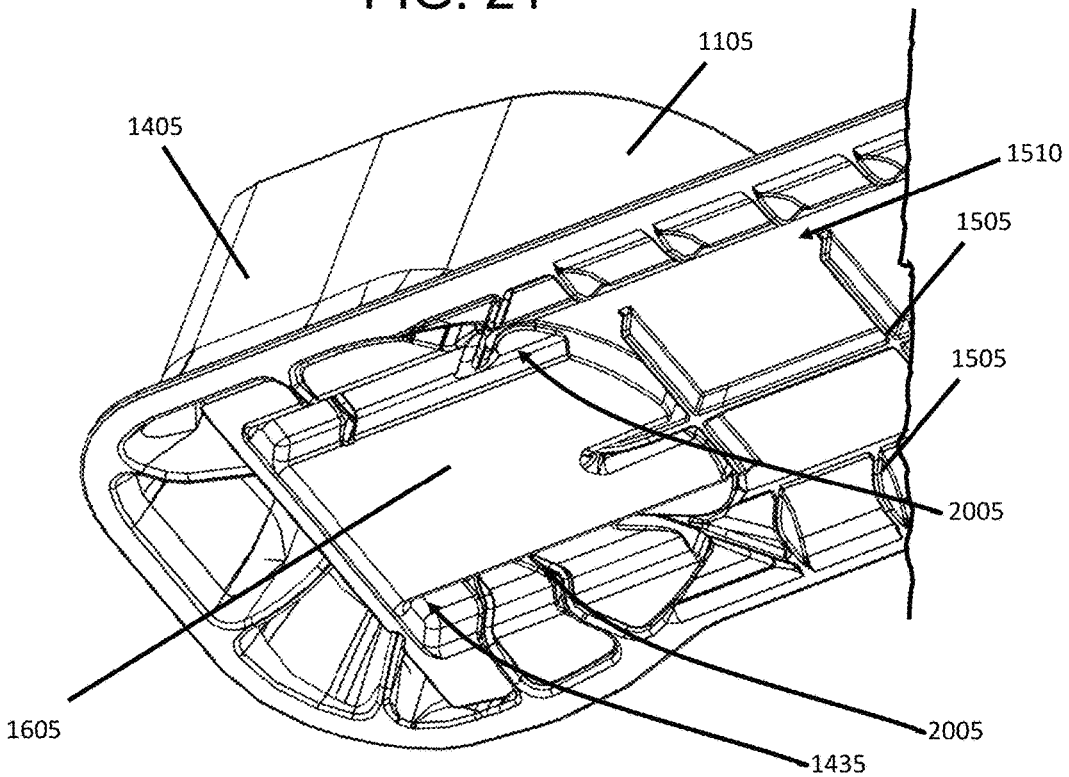
FIG. 22 is a bottom perspective view of the corner leg.

Referring to FIG. 20, the base 1605 defines one or more brace notches 2005 configured to receive the ribs 1225 of the brace 1215. FIGS. 21 and 22 show various perspective views of the corner leg 1105 when the corner insert 1205 is assembled with the rest of the corner leg 1105. As can be seen in FIG. 21, the stem 1610 of the corner insert 1205 is received in the hub cavity 1420 of the hub 1410. The petals 1615 of the corner insert 1205 fill an inner arc of the spoke cavities 1425 in the corner leg 1105, and the exterior facing spoke cavities 1425 of the corner leg 1105 (i.e., at the lead side 140) are empty of the petals 1615. At the end of the corner leg 1105 facing the load deck 115, the ends of the stem 1610 and petals 1615 extend into the depression 1435. In one example, the remaining volume of this depression 1435 is filled with a fill material, like ECC, and in another example, this volume is generally empty.

Figure 23:
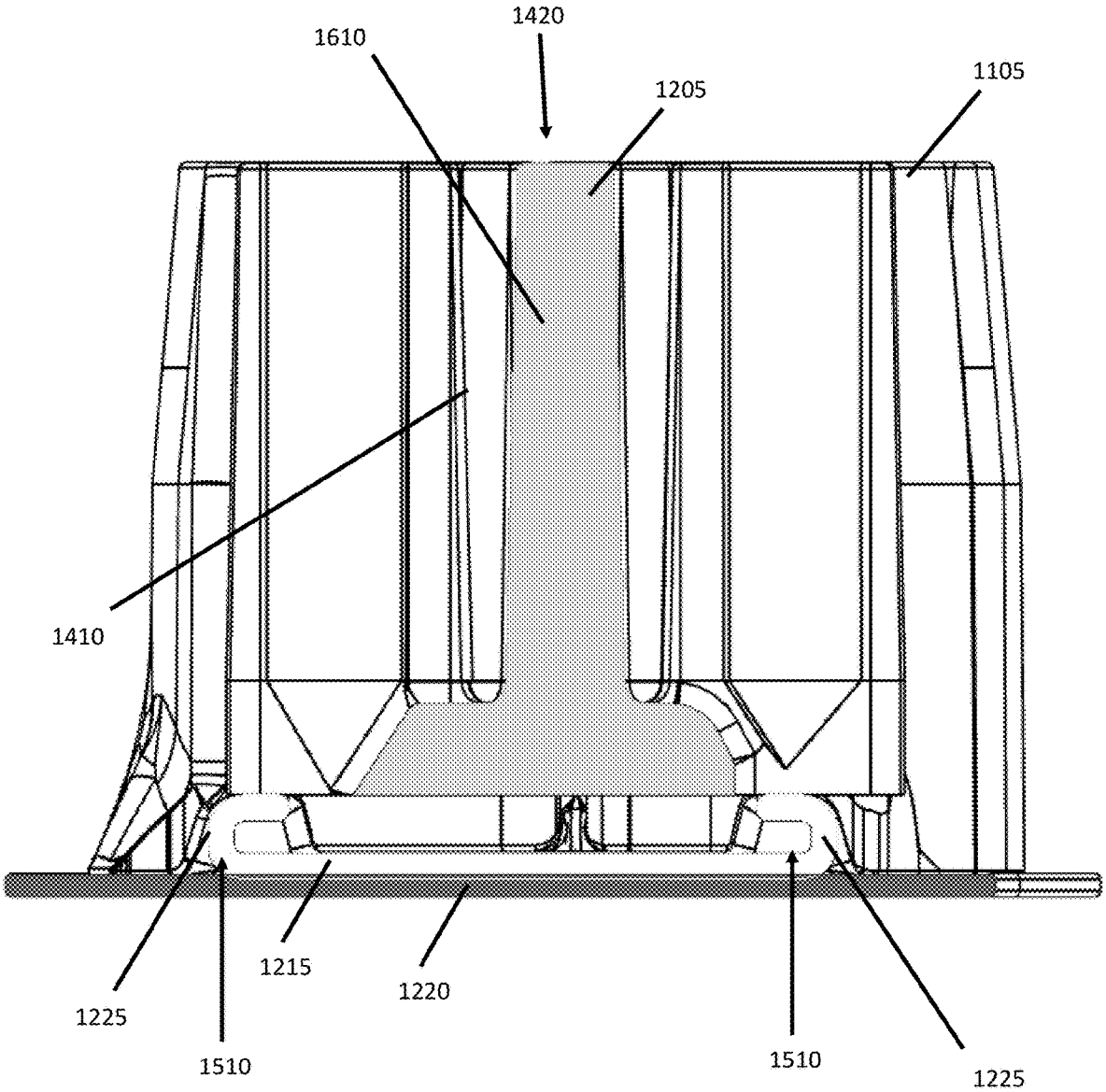
FIG. 23 is a cross-sectional view of the corner leg.

Looking at FIGS. 22 and 23, the base 1605 is generally located in the depression 1435 at the end of the corner legs 1105 facing the outer bridge cap 1220. The brace notches 2005 of the corner inserts 1205 are generally aligned with the brace channels 1510 of the corner legs 1105. When the outer leg-plank bridge 305 is assembled, the ribs 1225 of the brace 1215 are received in the brace channels 1510 and the brace notches 2005.

Figure 24:
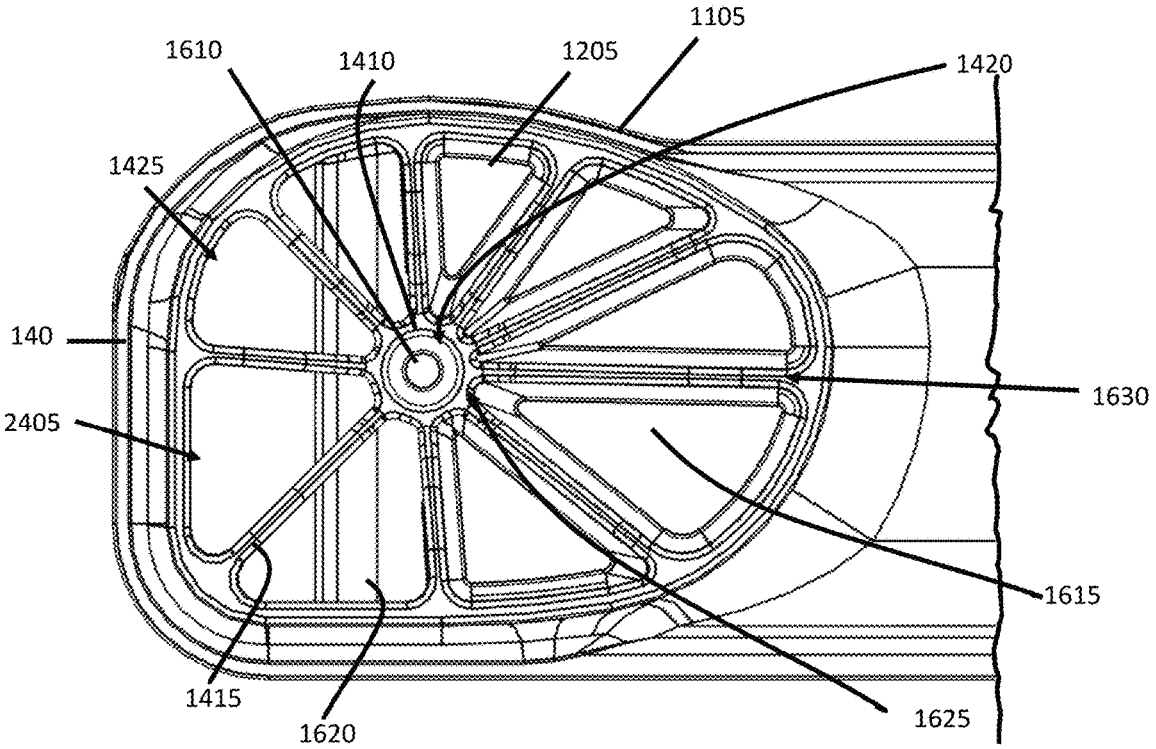
FIG. 24 is a top view of the corner leg.
Figure 25:
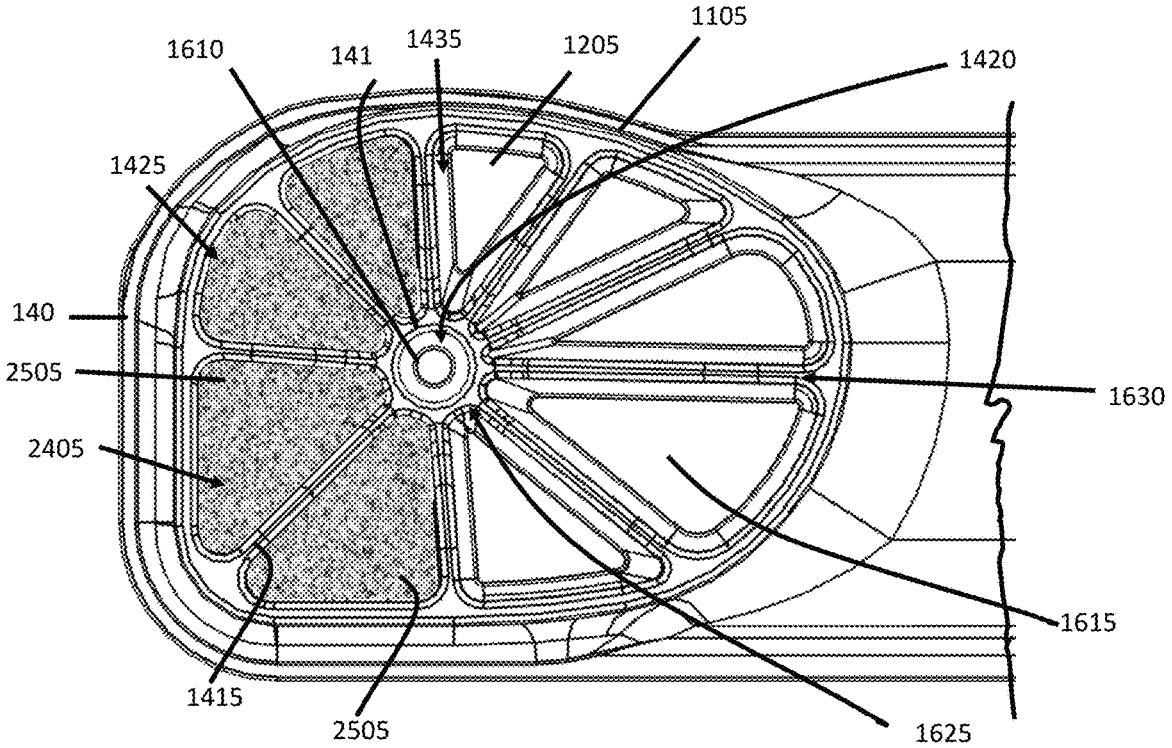
FIG. 25 is a top view of the corner leg with spoke cavities filled with concrete.

Turning to FIG. 24, the spoke cavities 1425 at the lead side 140 without the petals 1615 of the corner inserts 1205 form fill chambers 2405. Part of the foot 1620 of the corner inserts 1205 extends under these fill chambers 2405. Looking at FIG. 25, the fill chambers 2405 are partially or fully filled with concrete 2505. To provide added tensile strength and reduced cracking, the concrete 2505 in one form is made of ECC. The lead sides 140 of the pallet 100 are more prone to being hit with forks of forklifts as well as other objects. Having the concrete 2505 fill the fill chambers 2405 located at the lead side 140 makes the lead side 140 of the corner leg 1105 stronger and more durable. The concrete 2505 in the individual fill chambers 2405 form wedges that can wedge together so as to further resist impacts. During an impact, the stem 1610 in the hub cavity 1420 can further cushion the impact.

It was found that filling all of the spoke cavities 1425 with concrete 2505 made the pallet 100 very heavy. The interior sides of the corner legs 1105 are less prone to significant impacts. To reduce the weight of the pallet 100, the corner legs 1105 are only partially filled with concrete 2505. Having the spoke cavities 1425 filled with the petals 1615 of the foam corner inserts 1205 reduces the weight of the pallet 100 without dramatically impacting durability. The concrete 2505 in selected examples further fills the depressions 1435 to provide additional strength. With the concrete 2505 filling the depressions 1435, the concrete 2505 fills the spoke channels 1630 such that the hardened concrete 2505 is able to lock with the stem 1610 and the petals 1615 of the corner inserts 1205. In other examples, the depressions 1435 are not filled with concrete 2505.

Figure 26:
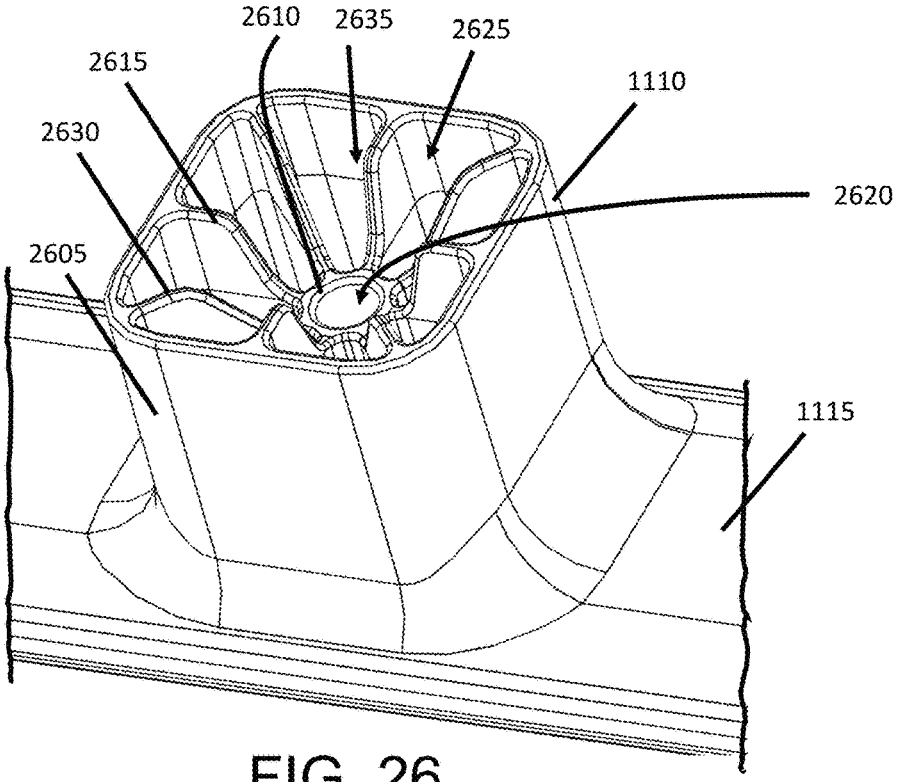
FIG. 26 is a top perspective view of a middle leg of the FIG. 11 outer leg-plank bridge.
Figure 27:
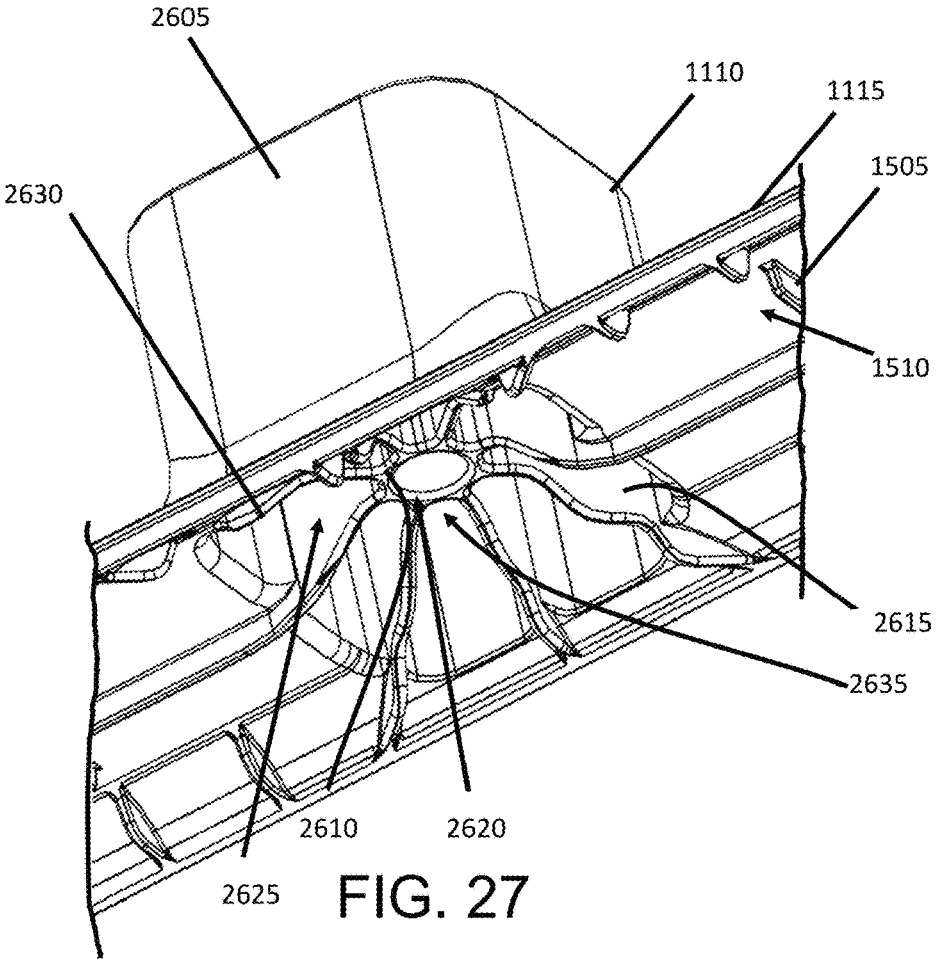
FIG. 27 is a bottom perspective view of the FIG. 26 middle leg.

FIG. 26 is a top perspective view of a middle leg 1110 of the outer leg-plank bridge 305. FIG. 27 is a bottom perspective view of the middle leg 1110. The middle leg 1110 has a rim wall 2605, a hub 2610, and one or more spoke walls 2615 that extend from the rim wall 2605 to the hub 2610. The hub 2610 defines a hub cavity 2620 configured to receive part of the middle insert 1210. One or more spoke cavities 2625 radially extend from the hub 2610 to the rim wall 2605, and the spoke cavities 2625 are defined by the rim wall 2605, hub 2610, and spoke walls 2615. The hub cavity 2620 and spoke cavities 2625 are arranged in a fashion similar to a wheel, flower, or pie. This arrangement helps to direct the impact forces radially inward which in turn strengthens the middle leg 1110.

The spoke walls 2615 have edges 2630 that are curved towards the hub 2610. The curved edges 2630 form opposing depressions 2635 in the middle leg 1110. Once more, as shown in FIG. 27, the outer bridge body 1115 of the outer leg-plank bridges 305 has a series of the ribs 1505 that strengthen the outer bridge body 1115. The ribs 1505 define the brace channels 1510 configured to receive the folded ribs 1225 of the brace 1215.

Figure 28:
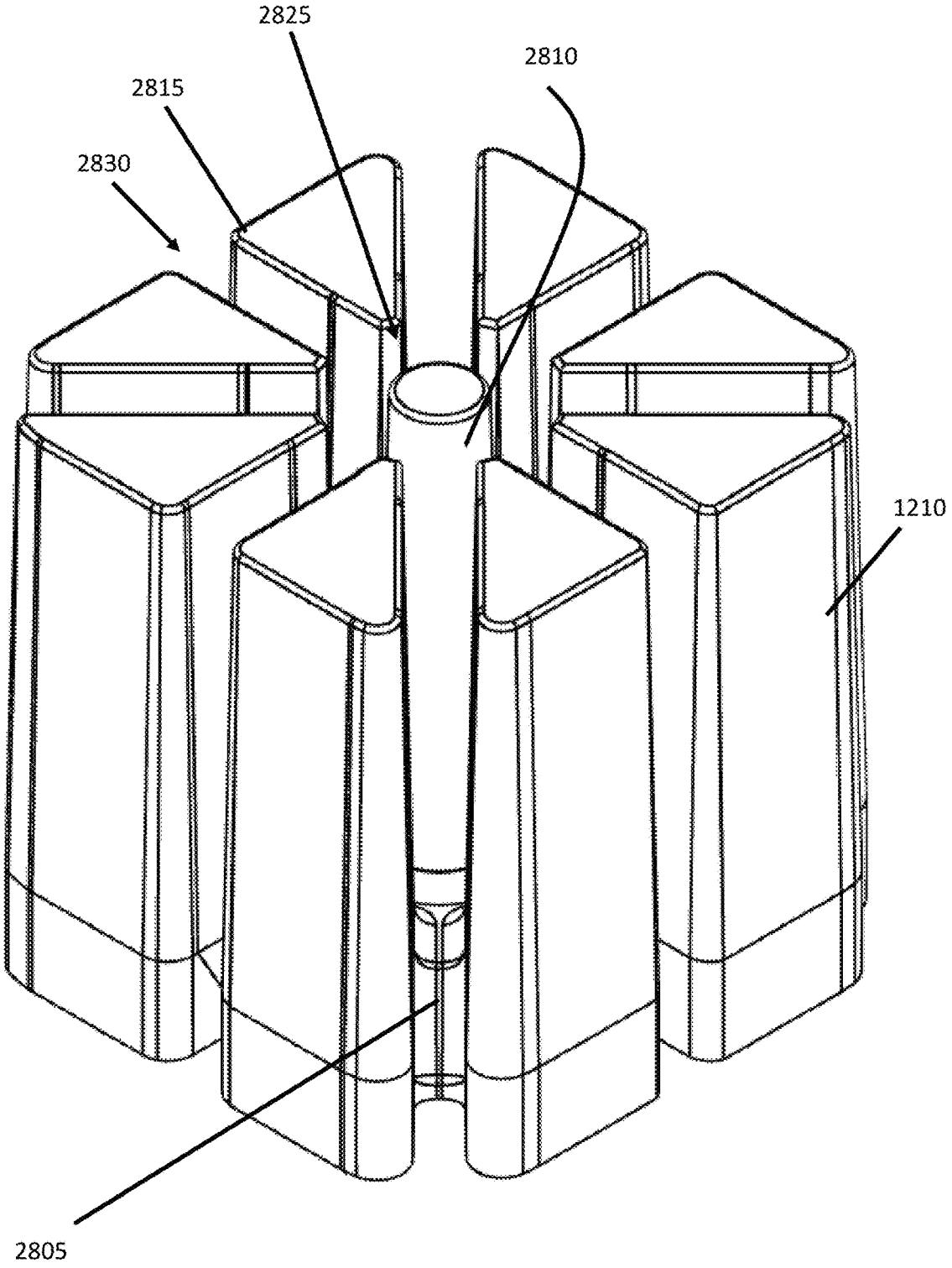
FIG. 28 is a perspective view of a middle insert in the FIG. 11 outer leg-plank bridge.
Figure 29:
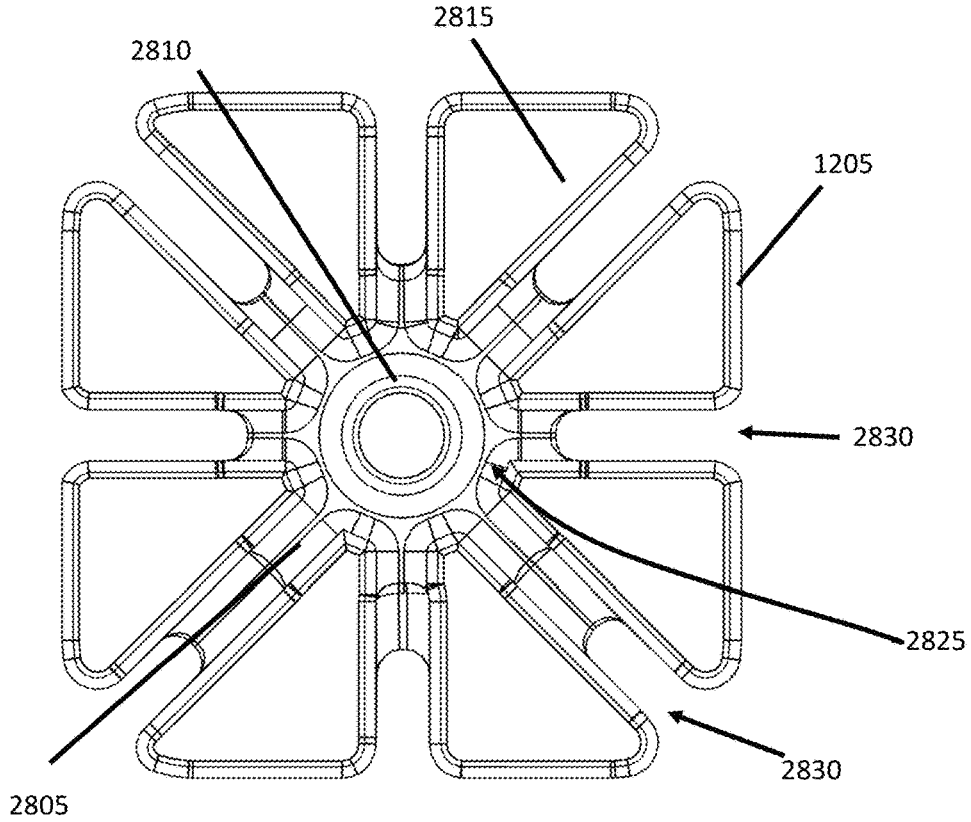
FIG. 29 is a top view of the FIG. 28 middle insert.
Figure 30:
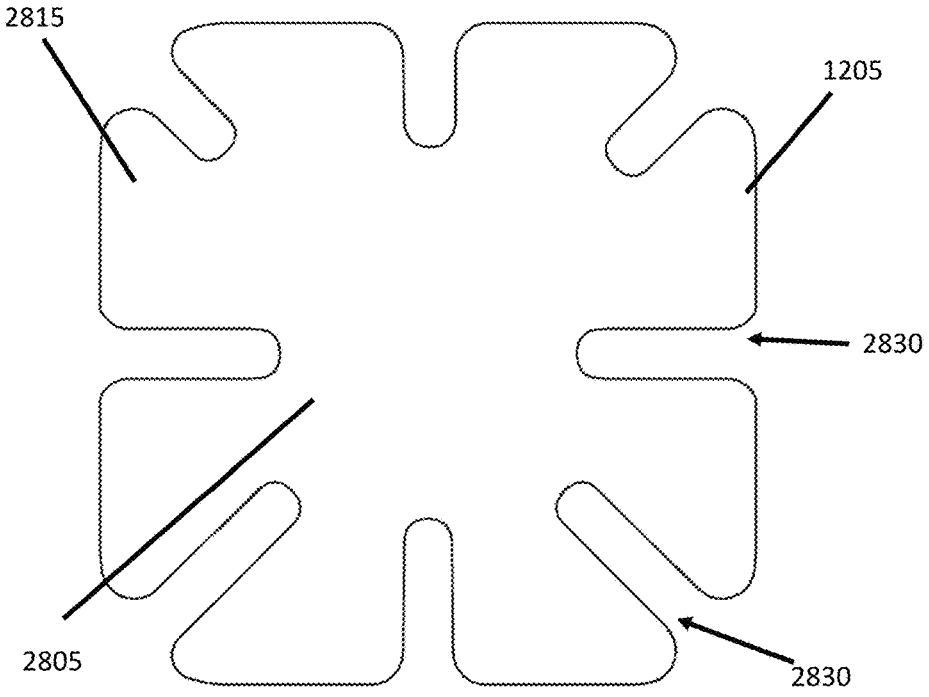
FIG. 30 is a bottom view of the FIG. 28 middle insert.

Looking at FIGS. 28, 29, and 30, the middle insert 1210 has a base 2805, a stem 2810, and one or more petals 2815. The stem 2810 extends from the base 2805, and the stem 2810 is configured to be received in the hub cavity 2620. In one form, the end of the stem 2810 has a frustoconical shape. The petals 2815 radially extend around the stem 2810 to fill the spoke cavities 2625. The ends of the stem 2810 and petals 2815 generally have the same height.

A hub channel 2825 is defined between the stem 2810 and petals 2815 to separate the stem 2810 from the petals 2815. The hub channel 2825 is adapted to receive the hub 2610. The petals 2815 define one or more spoke channels 2830 that receive the spoke walls 2615 of the middle leg 1110 when the middle insert 1210 is inserted into the middle leg 1110.

Figure 31:
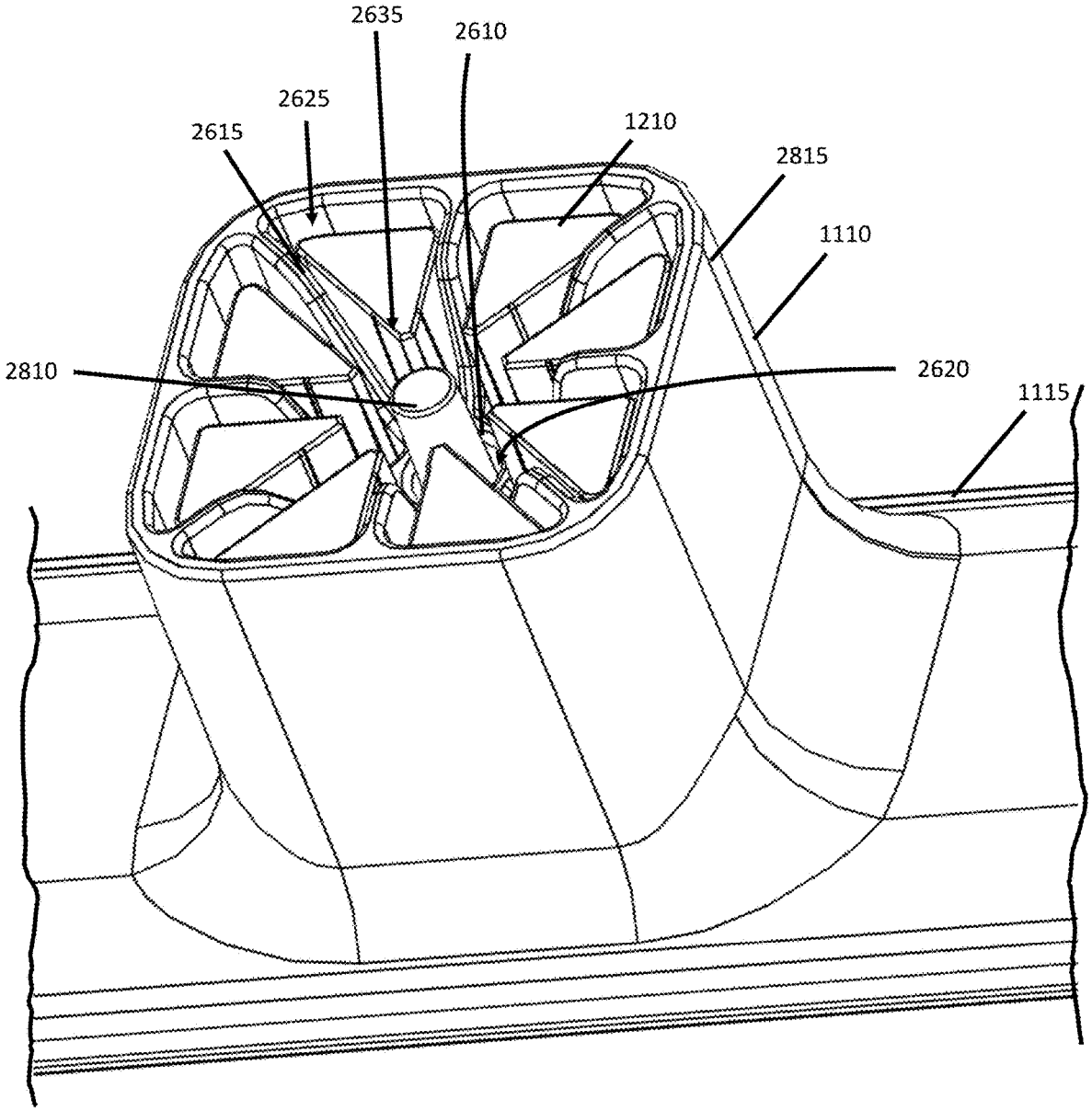
FIG. 31 is a top perspective view of the FIG. 26 middle leg with the FIG. 28 middle insert.
Figure 32:
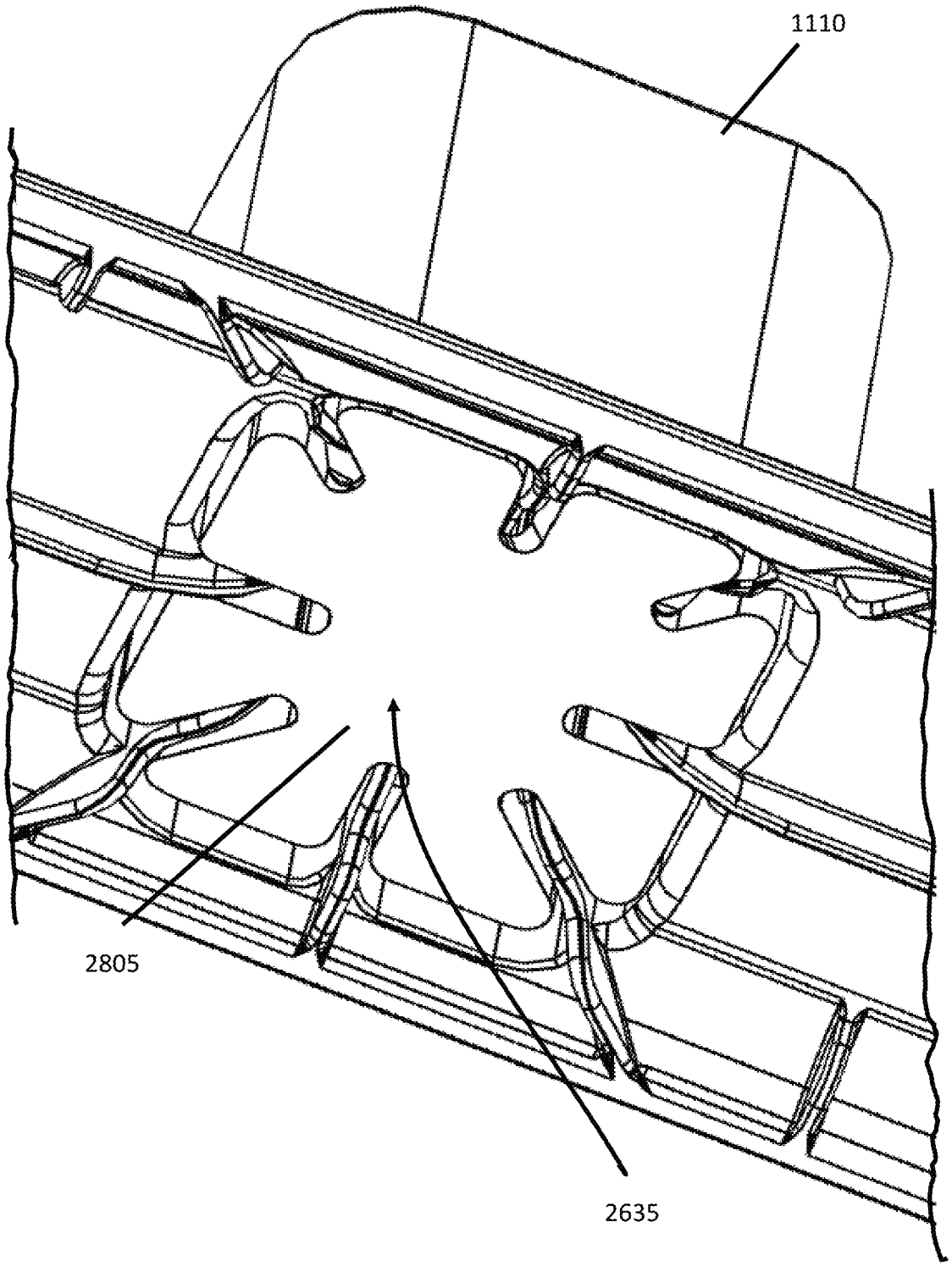
FIG. 32 is a bottom perspective view of the FIG. 31 middle leg.

FIGS. 31 and 32 show various perspective views of the middle leg 1110 when the middle insert 1210 is assembled with the rest of the middle leg 1110. As can be seen in FIG. 31, the stem 2810 of the middle insert 1210 is received in the hub cavity 2620 of the hub 2610. As illustrated in FIG. 32, the base 2805 is generally received in the depression 2635 that faces the outer bridge cap 1220.

By being located in the middle of the outer leg-plank bridge 305, the middle leg 1110 is less prone to severe impacts. In other words, the corner legs 1105 shield the middle leg 1110. To reduce the overall weight of the pallet 100, the middle leg 1110 in one variation only contains the middle insert 1210, and the middle leg 1110 is not filled with concrete 2505. In another variation, the middle leg 1110 is entirely or partly filled with concrete 2505.

Figure 33:
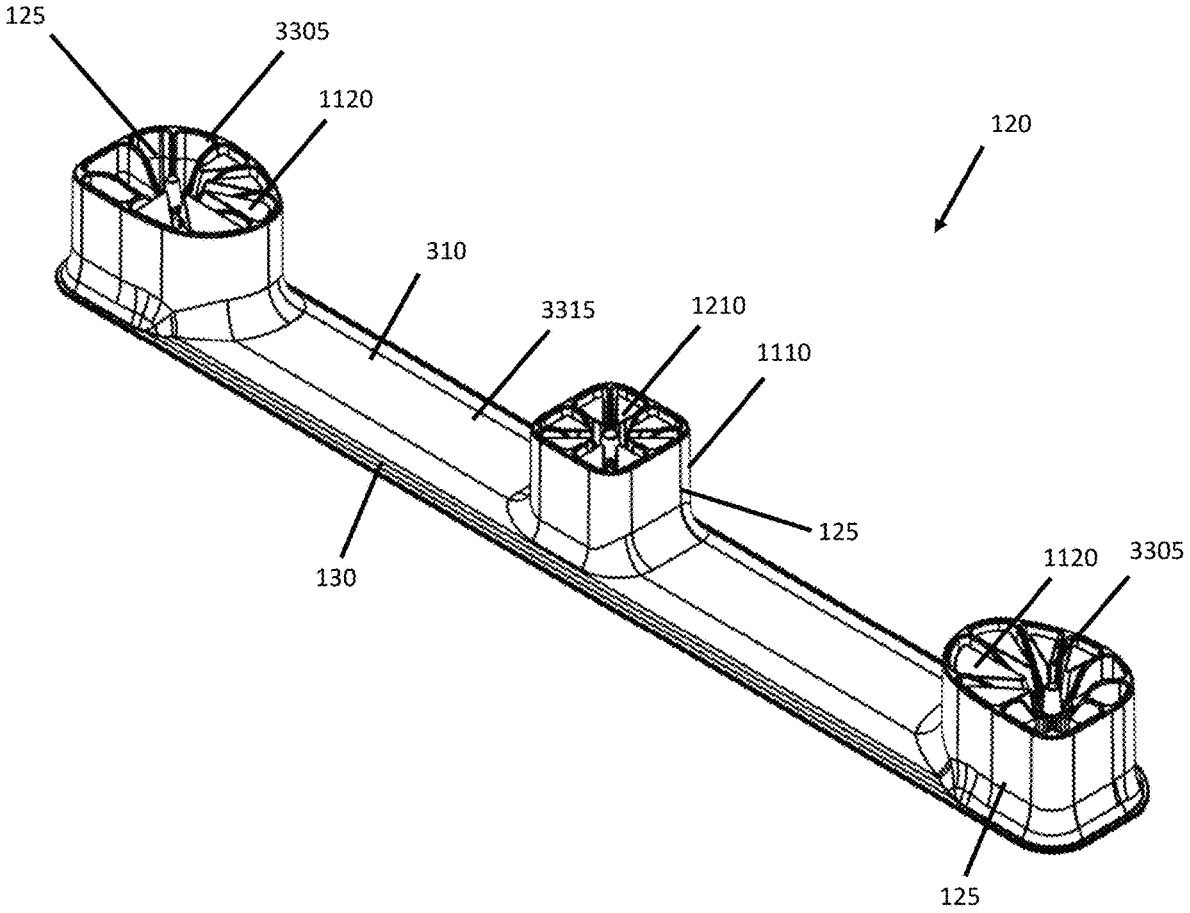
FIG. 33 is a perspective view of an inner leg-plank bridge in the FIG. 1 pallet.

FIG. 33 is a perspective view of the inner leg-plank bridge 310 in the pallet 100. The inner leg-plank bridge 310 includes one or more end legs 3305, the middle leg 1110, and an inner bridge body 3315 that are integrally formed together as a single component. For instance, the end legs 3305, middle leg 1110, and inner bridge body 3315 of the inner leg-plank bridge 310 in one version are created via injection molding plastic. The end legs 3305 are located at opposite ends of the of the inner leg-plank bridge 310. In particular, the end legs 3305 are located at the lead sides 140 of the pallet 100 when assembled. As alluded to before, the end legs 3305 are constructed to be lightweight, strong, and durable so as to resist damage from repeated fork and other types of impacts during routine use. The middle leg 1110 is sandwiched or located between the end legs 3305 along the inner bridge body 3315. The middle leg 1110 is constructed in the same fashion as the middle leg 1110 in the outer leg-plank bridges 305 (see e.g., FIGS. 26-32). For the sake of brevity and clarity, please refer to the previous description. Looking again at FIGS. 10 and 33, the end legs 3305 are configured to be welded or otherwise attached to the end sockets 1015 of the tray 805, and for the inner leg-plank bridge 310, the middle leg 1110 is configured to secure to the middle socket 1010 of the load deck 115.

Figure 34:
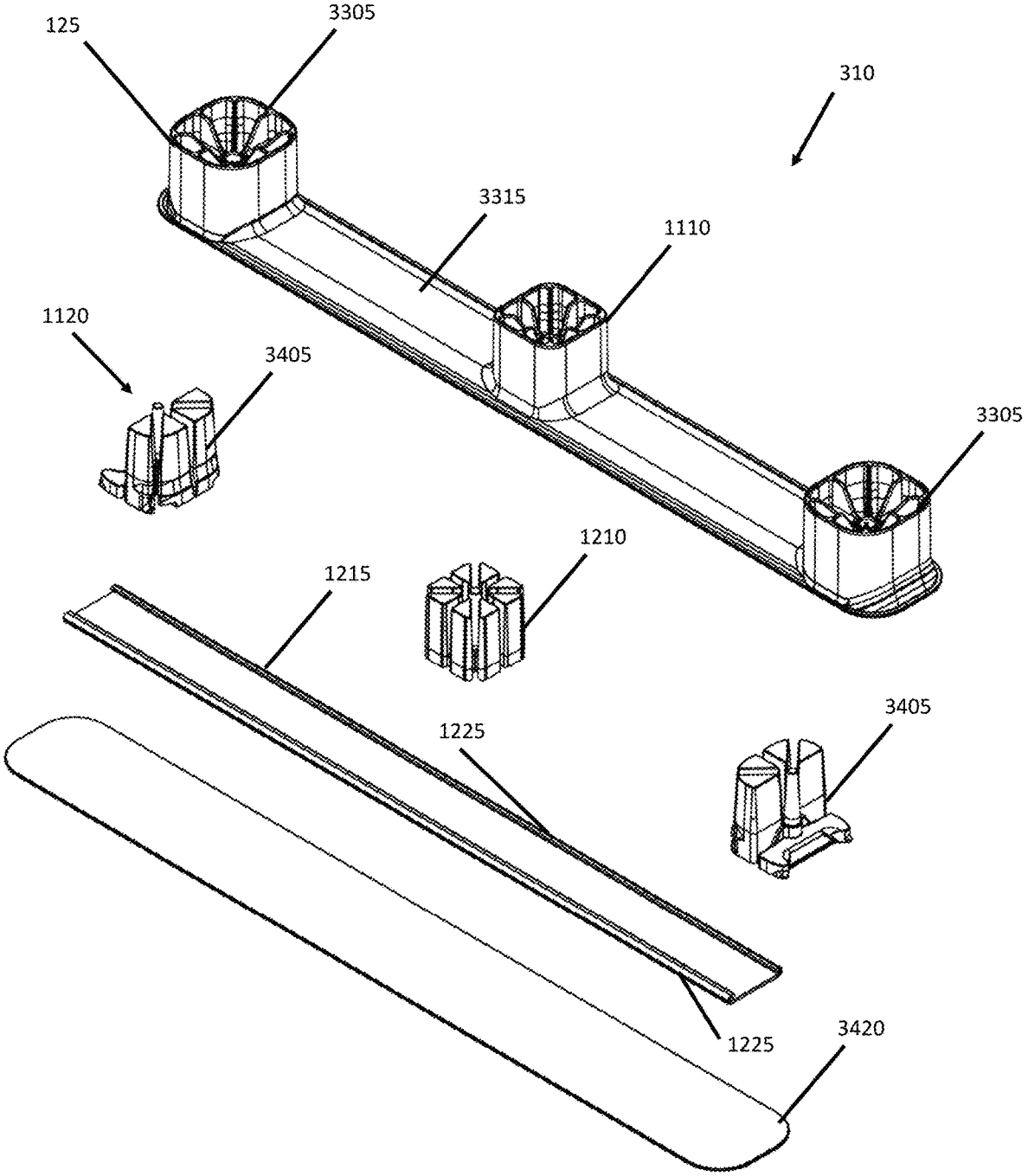
FIG. 34 is a top exploded view of the FIG. 33 inner leg-plank bridge.
Figure 35:
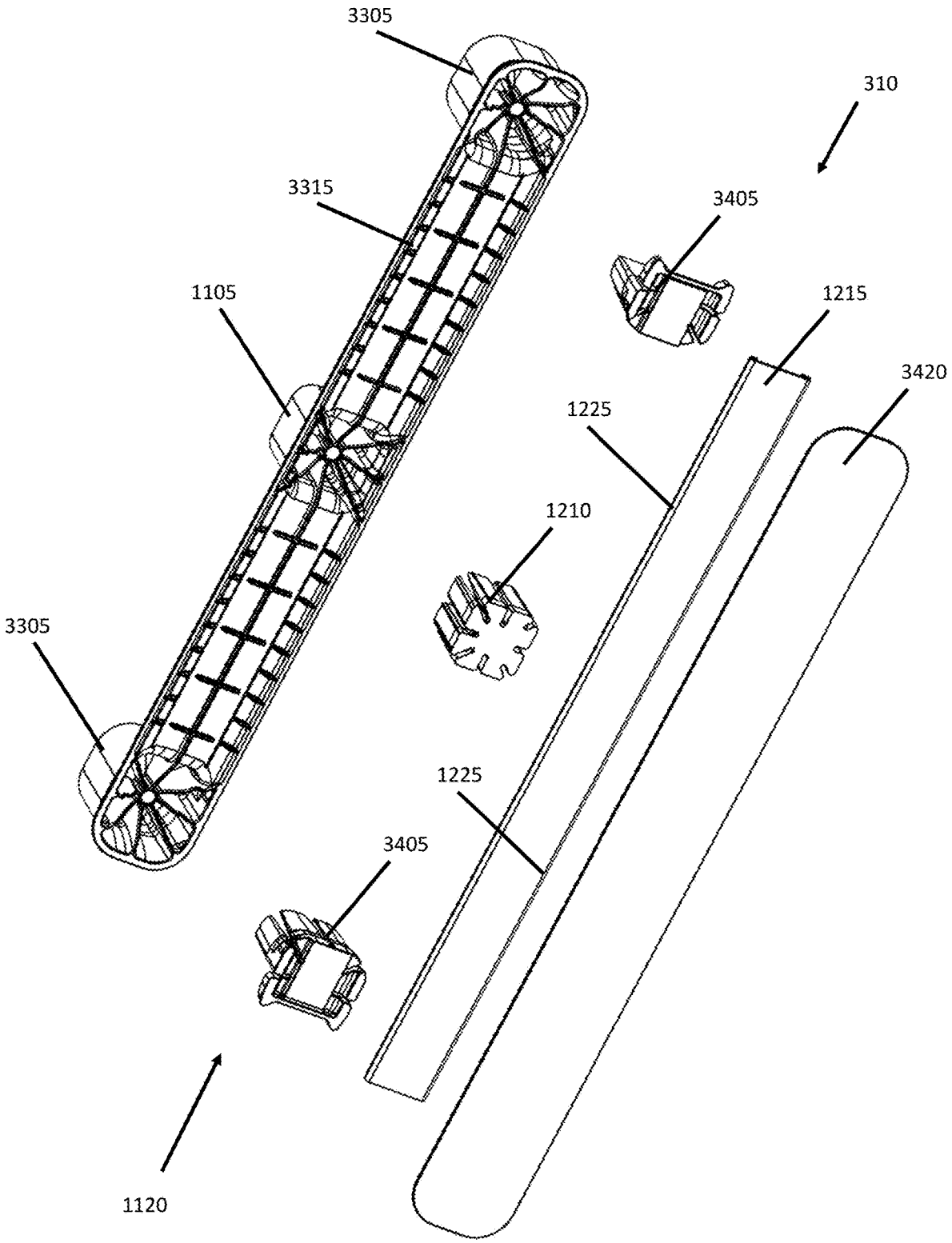
FIG. 35 is a bottom exploded view of the FIG. 33 inner leg-plank bridge.

FIG. 34 is a top exploded view of the inner leg-plank bridge 310, and FIG. 35 is a bottom exploded view of the inner leg-plank bridge 310. To reduce the weight of the inner leg-plank bridge 310 and absorb shock from impacts, the inner leg-plank bridge 310 includes the inserts 1120 that are received inside the legs 125. The inserts 1120 are made of a plastic foam material such as expanded polystyrene foam. Looking at FIG. 34, the inserts 1120 in the inner leg-plank bridge 310 include one or more end inserts 3405 and the middle insert 1210.

The inner leg-plank bridge 310 further include the brace 1215 and an inner bridge cap 3420. The brace 1215 is configured to stiffen the inner leg-plank bridge 310. The brace 1215 in the illustrated example is in the form of a c-channel type brace that is made of a fiber reinforced composite material, such as fiberglass and carbon fiber materials, and in other examples, the brace 1215 is made from metal, such as aluminum and steel. Again, the longitudinal sides of the brace 1215 are bent or folded to form the ribs 1225 that further stiffen the brace 1215. The inner bridge cap 3420 is configured to enclose and/or retain the inserts 1120 and brace 1215 inside the inner leg-plank bridge 310. The inner bridge cap 3420 in one version is welded to the periphery of the inner bridge body 3315 via ultrasonic welding to provide a watertight seal, and in other versions, the inner bridge body 3315 can be secured in other ways such as via adhesives and fasteners.

The ends of the end legs 3305 facing the lead sides 140 are generally not filled with the end inserts 3405, but are filled with a hardened filler material, like concrete 2505, so as to make the end legs 3305 stronger and more durable to resist fork impacts. Like before, the middle leg 1110 is almost completely filled with the middle insert 1210. The end legs 3305 generally have a symmetrical shape.

Figure 36:
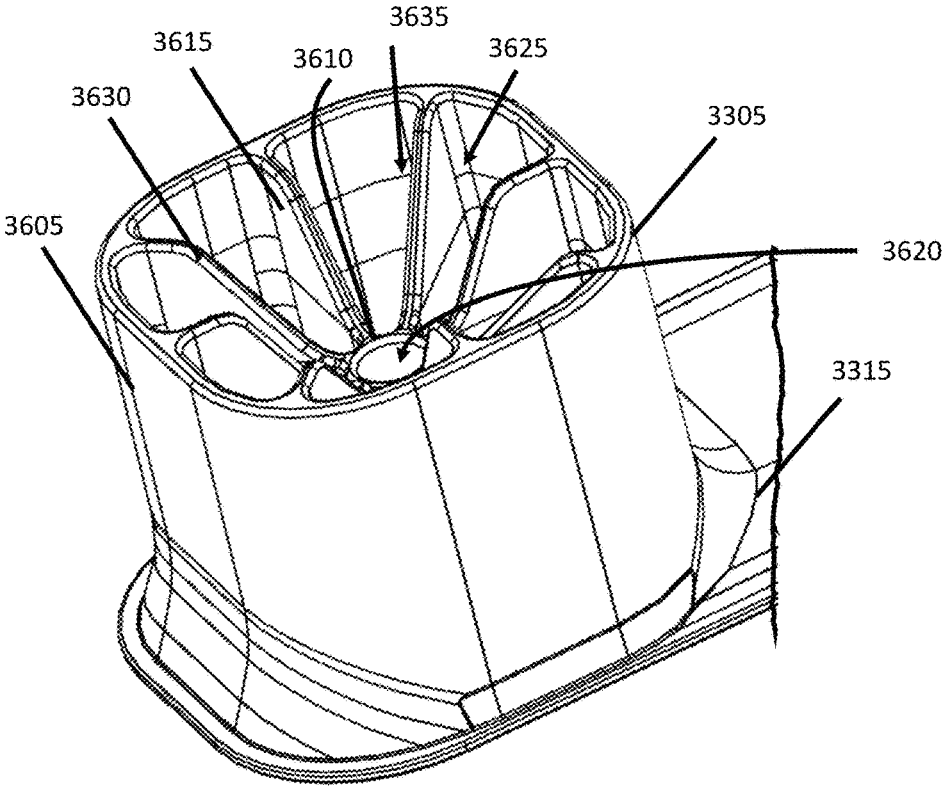
FIG. 36 is a top perspective view of an end leg on the FIG. 33 inner leg-plank bridge.

As depicted in FIG. 36, the end legs 3305 have a rim wall 3605, a hub 3610, and one or more spoke walls 3615 that extend from the rim wall 3605 to the hub 3610. The hub 3610 defines a hub cavity 3620 configured to receive part of the end insert 3405. One or more spoke cavities 3625 radially extend from the hub 3610 to the rim wall 3605, and the spoke cavities 3625 are defined by the rim wall 3605, hub 3610, and spoke walls 3615. The hub cavity 3620 and spoke cavities 3625 are arranged in a fashion similar to a wheel, flower, or pie. This arrangement directs any impact forces radially inward which in turn strengthens the corner legs 1105.

The spoke walls 3615 have one or more edges 3630. The edges 3630 curve towards the hub 3610 to define depressions 3635 at opposite ends of the end legs 3305. In one form, the depressions 3635 are configured to be filled with a portion of the end inserts 3405 and concrete 2505.

Figure 37:
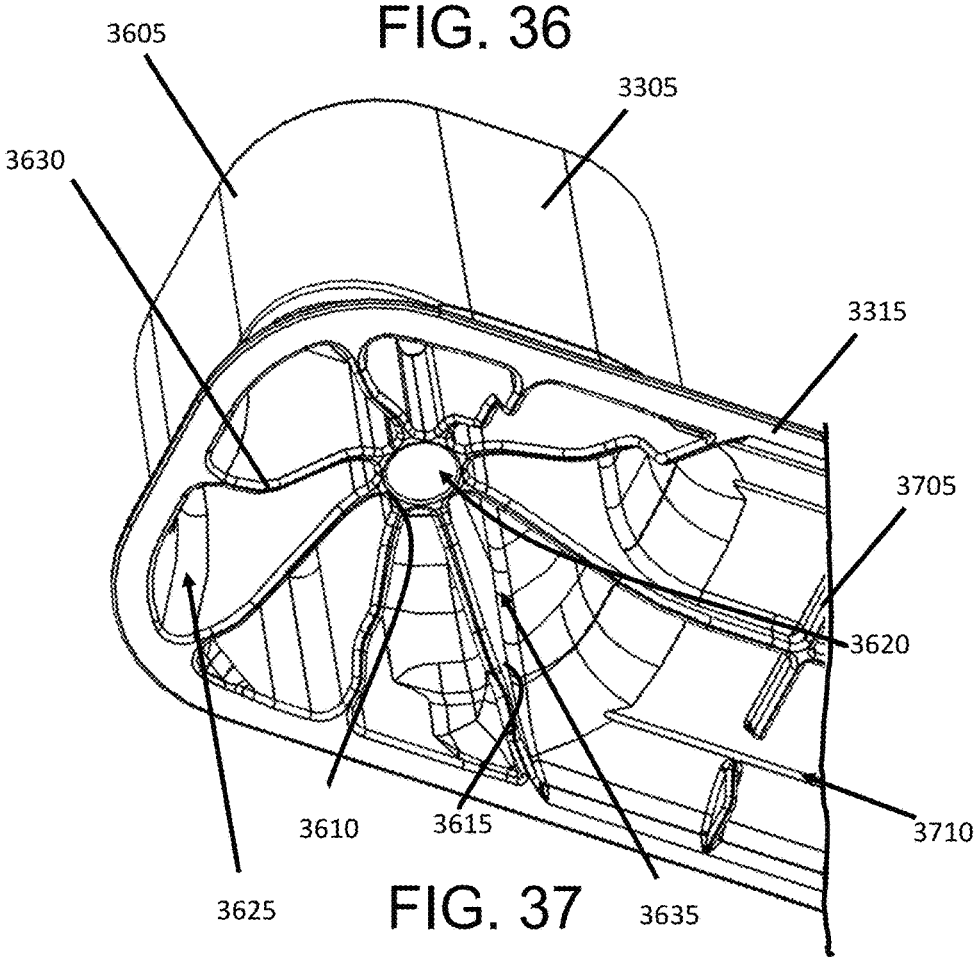
FIG. 37 is a bottom perspective view of the FIG. 36 end leg.
Figure 38:
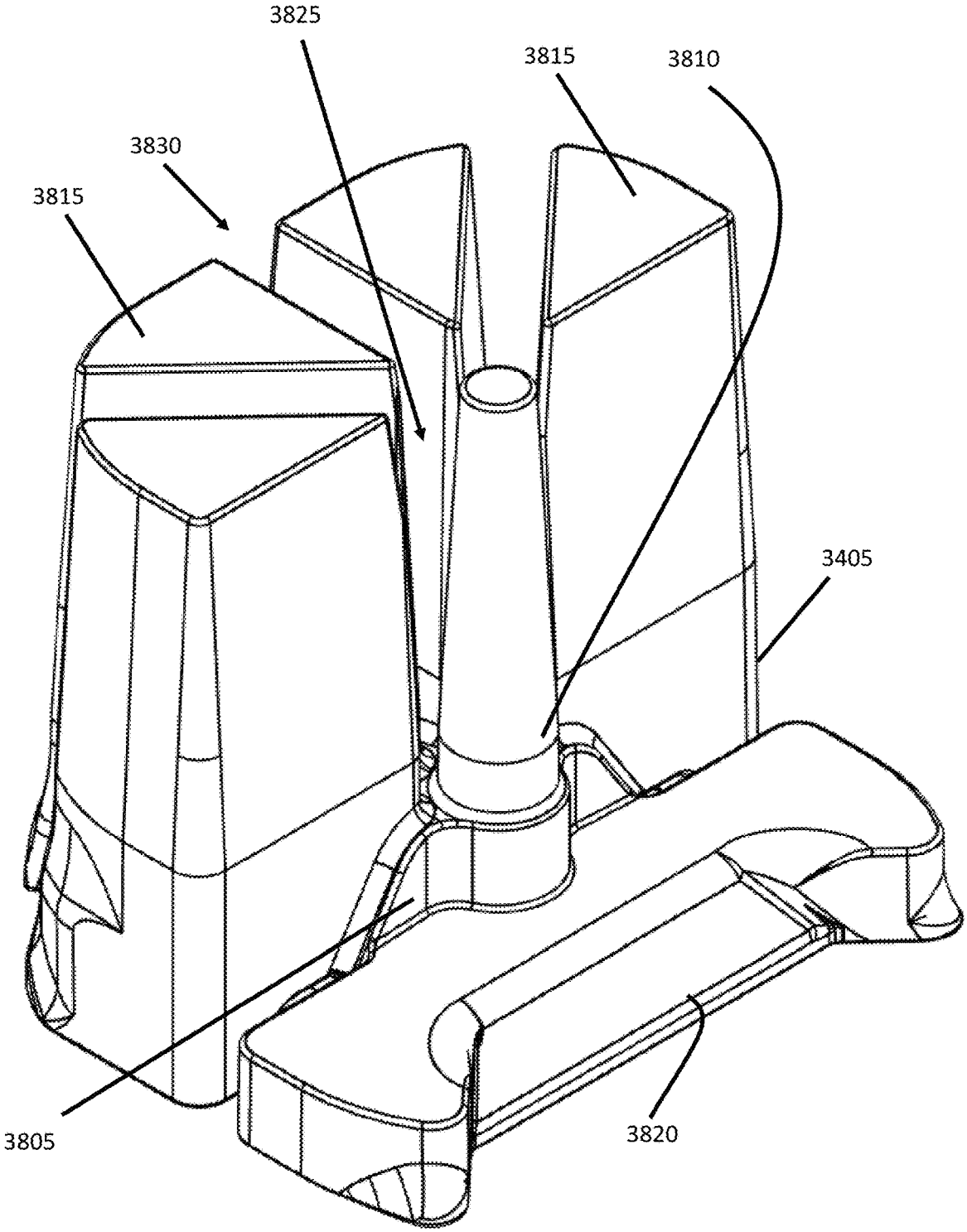
FIG. 38 is a front perspective view of an end insert for the FIG. 36 end leg.
Figure 39:
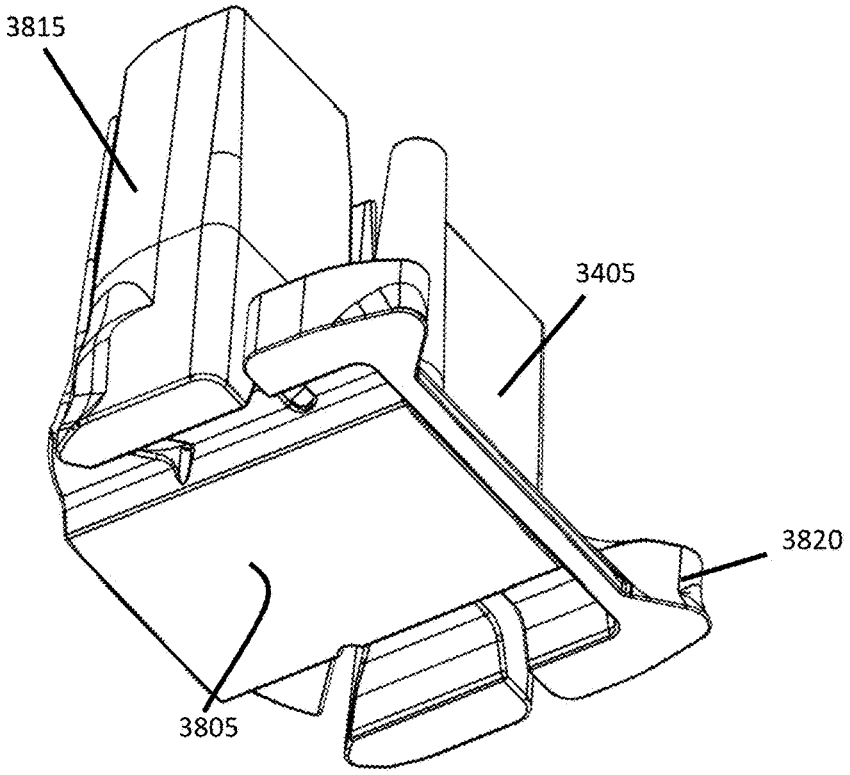
FIG. 39 is a bottom perspective view of the FIG. 38 end insert.
Figure 40:
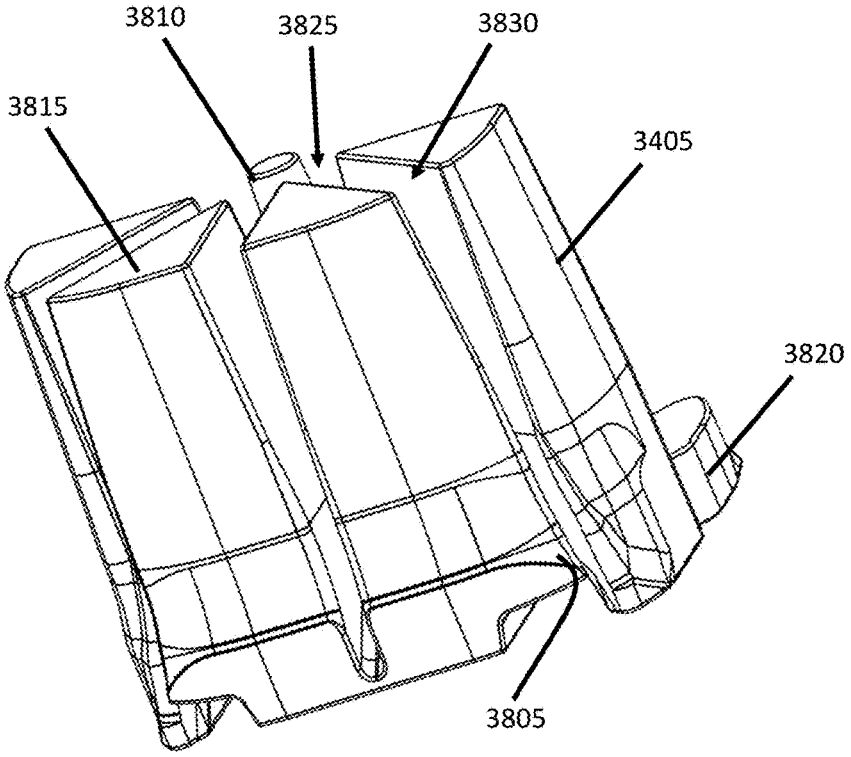
FIG. 40 is a rear perspective view of the FIG. 38 end insert.
Figure 41:
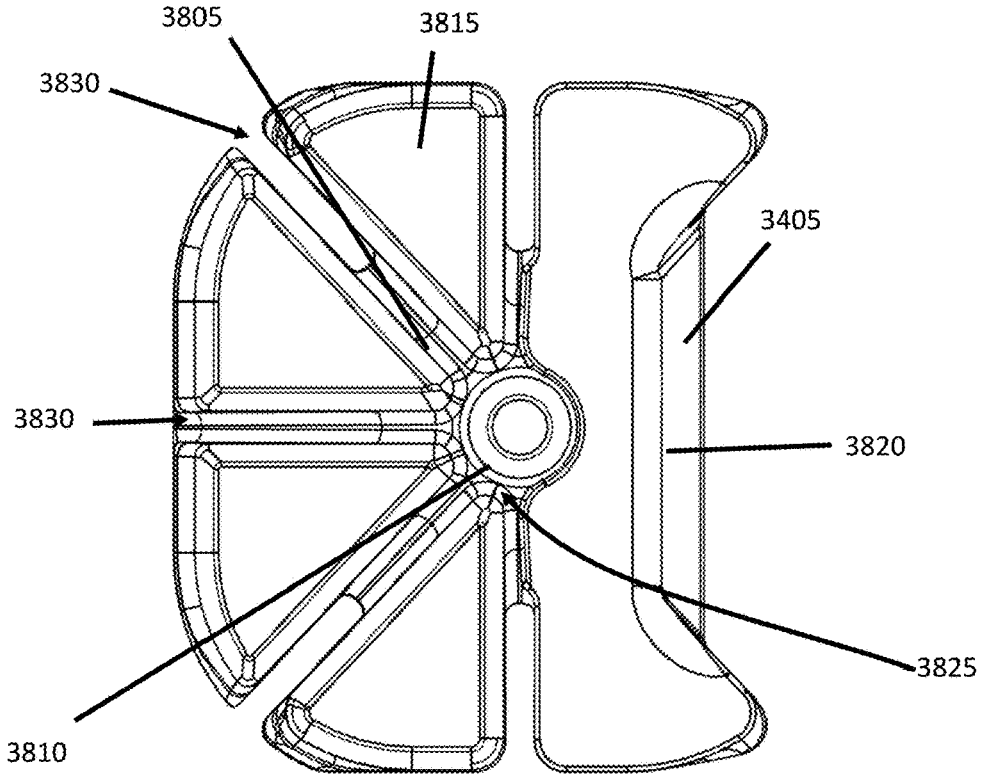
FIG. 41 is a top view of the FIG. 38 end insert.

As shown in FIG. 37, the inner bridge body 3315 of the inner leg-plank bridge 310 has a series of one or more ribs 3705 that strengthen the inner bridge body 3315. The ribs 3705 define one or more brace channels 3710. The brace channels 3710 are configured to receive the folded longitudinal ribs 1225 of the brace 1215.

Looking at FIGS. 38, 39, 40, and 41, the end inserts 3405 have a base 3805, a stem 3810, one or more petals 3815, and a foot 3820. The stem 3810 extends from the base 3805, and the stem 3810 is configured to be received in the hub cavity 3620. In one form, the end of the stem 3810 has a frustoconical shape. The petals 3815 radially extend around part of the stem 3810 to fill some of the spoke cavities 3625 that face the interior of the pallet 100. The foot 3820 extends from the base 3805 at a location opposite the petals 3815. The ends of the stem 3810 and petals 3815 generally have the same height.

A hub channel 3825 is defined between the stem 3810 and petals 3815 to separate the stem 3810 from the petals 3815. The hub channel 3825 is adapted to receive the hub 3610. The petals 3815 define one or more spoke channels 3830 that receive the spoke walls 3615 of the end legs 3305 when the end inserts 3405 are inserted into the end legs 3305.

Figure 42:
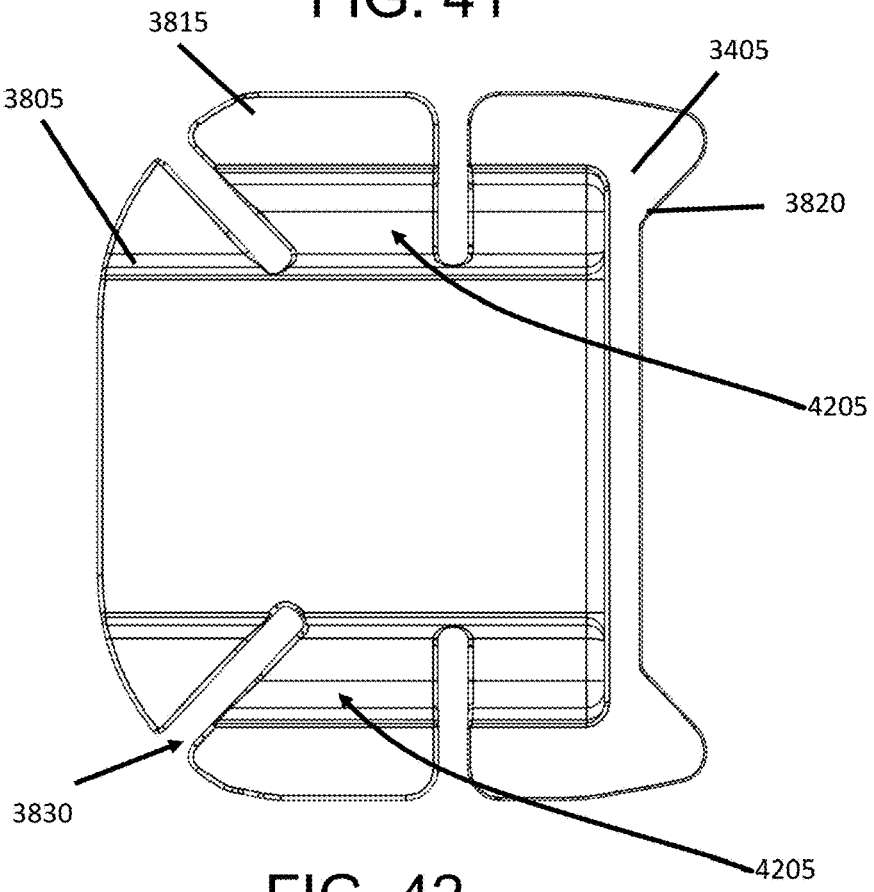
FIG. 42 is a bottom view of the FIG. 38 end insert.
Figure 43:
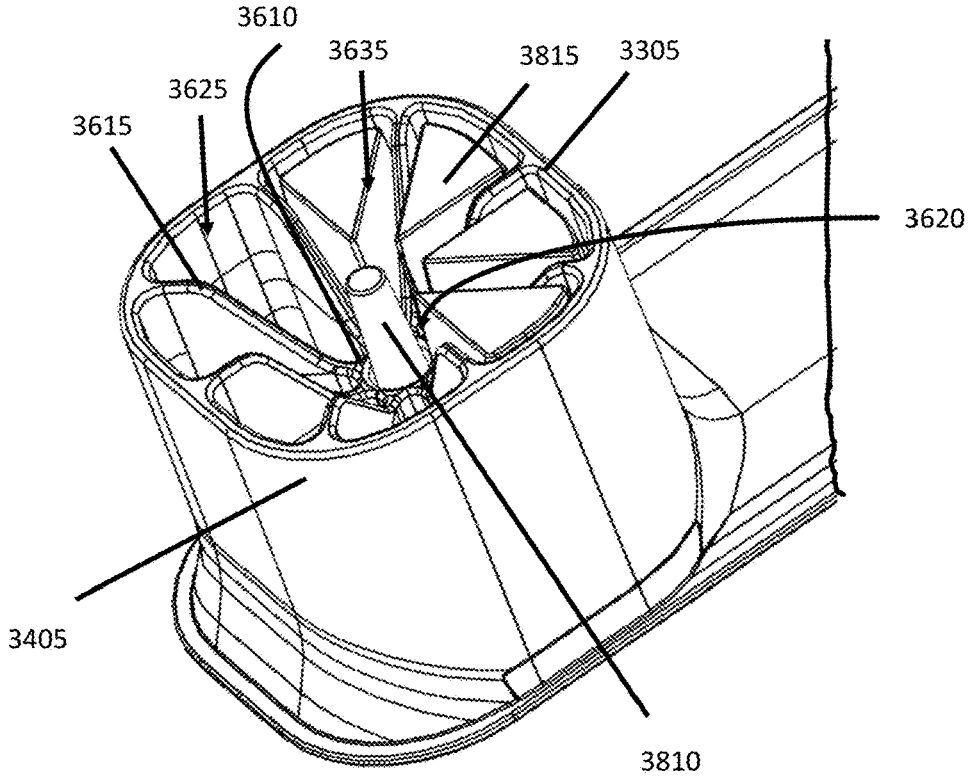
FIG. 43 is a top perspective view of the FIG. 36 end leg with the FIG. 38 end insert.
Figure 44:
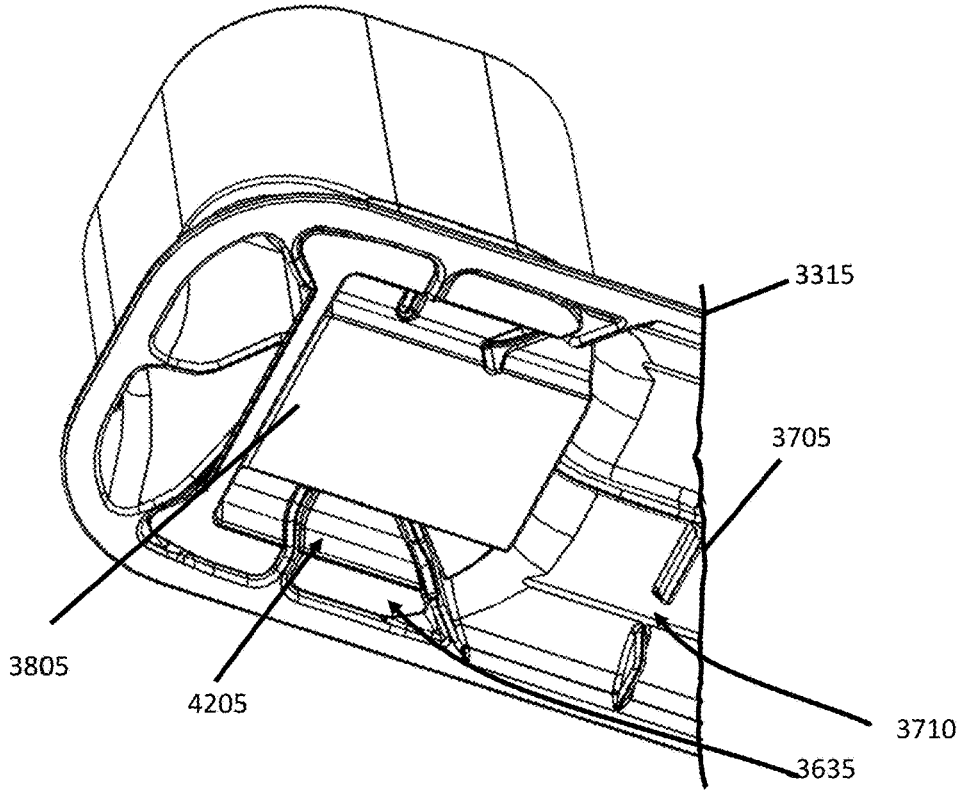
FIG. 44 is a bottom perspective view of the FIG. 43 end leg.

Referring to FIG. 42, the base 3805 defines one or more brace notches 4205 configured to receive the ribs 1225 of the brace 1215. FIGS. 43 and 44 show various perspective views of the end leg 3305 when the end insert 3405 is assembled with the rest of the end leg 3305. As can be seen in FIG. 43, the stem 3810 of the end insert 3405 is received in the hub cavity 3620 of the hub 3610. The petals 3815 of the end insert 3405 fill an inner arc of the spoke cavities 3625 in the end leg 3305, and the exterior facing spoke cavities 3625 of the end leg 3305 (i.e., at the lead side 140) are empty of the petals 3815. At the end of the end leg 3305 facing the load deck 115, the ends of the stem 3810 and petals 3815 extend into the depression 3635. In one example, the remaining volume of this depression 3635 is filled with concrete 2505, like ECC, and in another example, this volume is generally empty.

Figure 45:
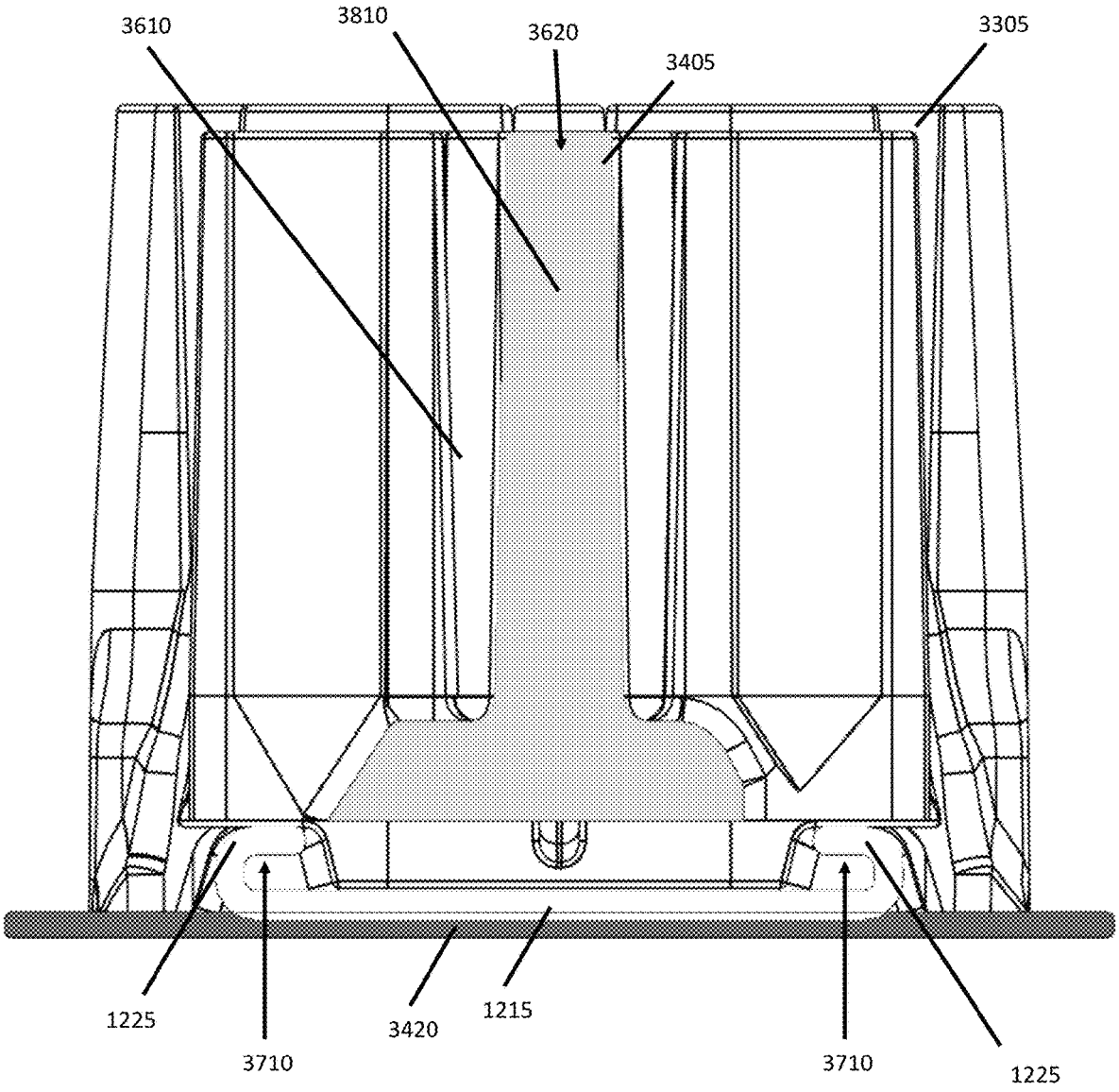
FIG. 45 is a cross-sectional view of the end leg

Looking at FIGS. 44 and 45, the base 3805 is generally located in the depressions 3635 at the end of the end legs 3305 facing the inner bridge cap 3420. The brace notches 4205 of the end inserts 3405 are generally aligned with the brace channels 3710 of the ribs 3705. When the inner leg-plank bridge 310 is assembled, the ribs 1225 of the brace 1215 are received in the brace channels 3710 and brace notches 4205.

Figure 46:
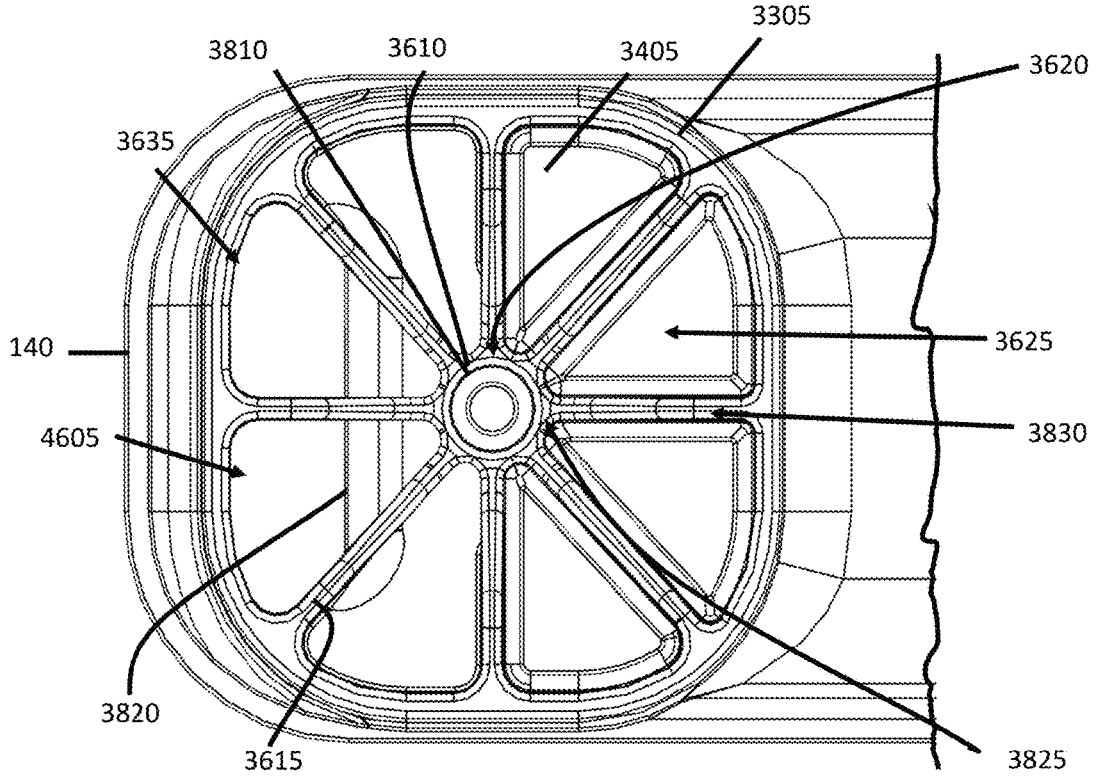
FIG. 46 is a top view of the FIG. 43 end leg.
Figure 47:
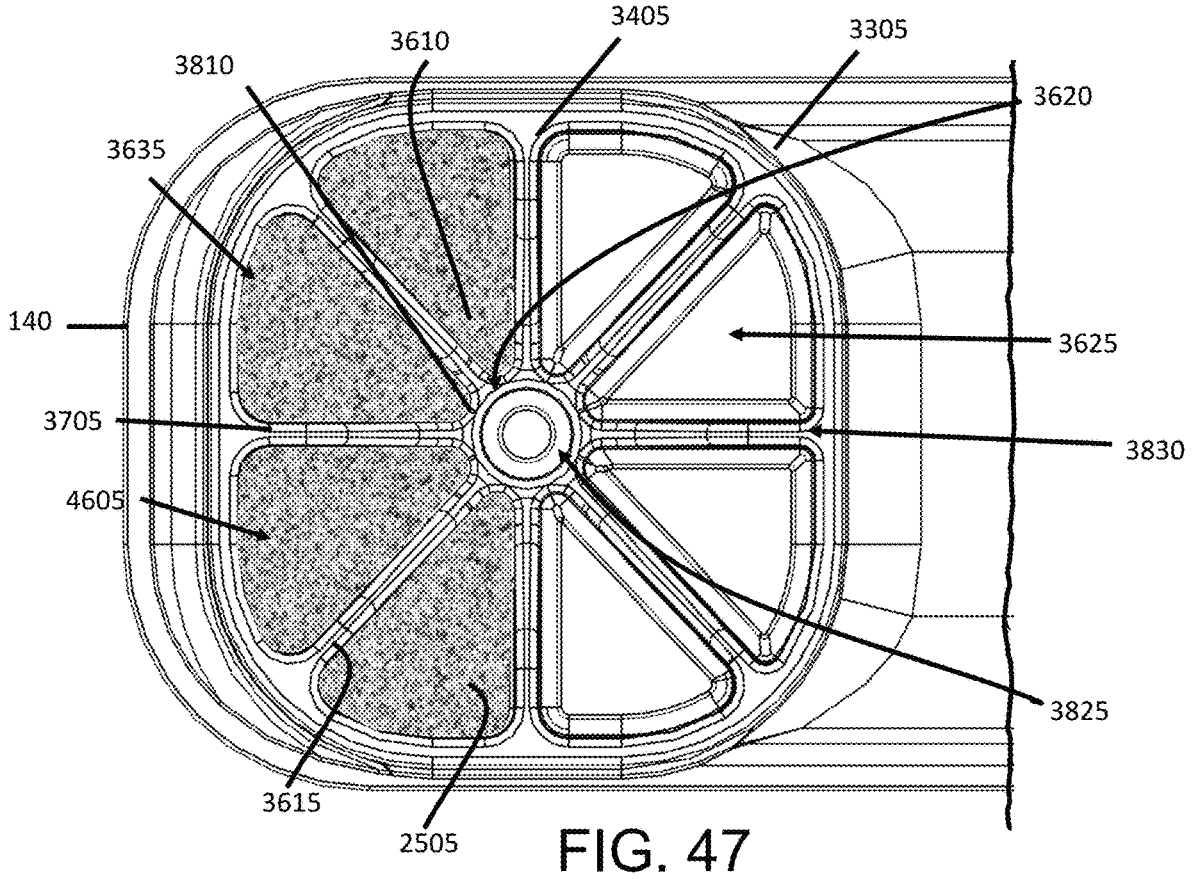
FIG. 47 is a top view of the end leg with spoke cavities filled with concrete.

Turning to FIG. 46, the spoke cavities 3625 at the lead side 140 without the petals 3815 of the end inserts 3405 form fill chambers 4605. Part the foot 3820 of the end insert 3405 extends under these fill chambers 4605. Looking at FIG. 47, the fill chambers 4605 are partially or fully filled with concrete 2505. To provide added tensile strength and reduced cracking, the concrete 2505 in one version is made of ECC. The lead sides 140 of the pallet 100 are more prone to being hit with forks of forklifts as well as other objects. Having the concrete 2505 fill the fill chambers 4605 located at the lead side 140 makes the lead side 140 of the end leg 3305 stronger and more durable. The concrete 2505 in the individual fill chambers 4605 form wedges that can wedge together so as to further resist impacts. During an impact, the stem 3810 in the hub cavity 3620 can further cushion the impact.

It was found that filling all of the spoke cavities 3625 with concrete 2505 made the pallet 100 very heavy. The interior sides of the end legs 3305 are less prone to significant impacts. To reduce the weight of the pallet 100, the end legs 3305 are only partially filled with concrete 2505. Having the spoke cavities 3625 filled with the petals 3815 of the foam end inserts 3405 reduces the weight of the pallet 100 without dramatically impacting durability. The concrete 2505 in selected examples further fills the depressions 3635 to provide additional strength. With the concrete 2505 filling the depressions 3635, the concrete 2505 fills the spoke channels 3830 such that the hardened concrete 2505 is able to lock with the stem 3810 and the petals 3815 of the end inserts 3405. In other example, the depressions 3635 are not filled with concrete 2505.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Adhesive" generally refers to any non-metallic substance applied to one or both surfaces of two separate parts that binds them together and resists their separation. For example, an adhesive can bond both mating surfaces through specific adhesion (e.g., molecular attraction), through mechanical anchoring (e.g., by flowing into holes in porous surfaces), and/or through fusion (e.g., partial solution of both surfaces in the adhesive or its solvent vehicle). Some non-limiting examples of adhesives include liquid adhesives, film adhesives, resin adhesives, rubber adhesives, silicone-based adhesives, mastics, metal-to-metal adhesives, plastic adhesives, rubber adhesives, sprayable adhesives, and hot melt adhesives, to name just a few.

"Asymmetric" or "Asymmetrical" generally refers to a property of something having two sides or halves that are different from one another, such as in shape, size, and/or style. In other words, asymmetric describes something lacking a mirror-image quality.

"Cavity" generally refers to an empty space in a solid object. The cavity can be completely or partially surrounded by the solid object. For example, the cavity can be open to the surrounding environment.

"Channel" generally refers to a long, narrow groove in a surface of an object.

"Concrete" generally refers to a material made from a mixture of broken stone or gravel, sand, cement, and water that can be spread/poured into molds and/or extruded to form a stone like mass on hardening.

"Contiguous" means adjacent or side by side.

"Continuous" generally refers to something marked by uninterrupted extension in space, time, and/or sequence. For example, a continuous line or surface has no gaps and/or holes in it. In other words, something that is continuous is unbroken.

"Deck" generally refers to a surface of a pallet, including one or more boards and/or panels, with or without space between the elements. Pallets can typically include one or more of the following types of decks: a top deck and/or a bottom deck. The directional terms "top" and "bottom" when referring to these types of deck are common nomenclature used in industry, and it is not the intent that these directional terms limit the types of decks to a specific orientation or direction. For example, in a reversible pallet, the pallet has identical or similar top and bottom decks that can be flipped on either face of the pallet to support the unit load.

"Engineered Cementitious Composite" (ECC), also known as "bendable concrete" or "engineered cementitious concrete", generally refers to a type of concrete composite material that is reinforced with short random polymer fibers, such as polyvinyl alcohol (PVA) fibers. These polymer fibers may be used in a low volume fraction, such as 2-3% by volume, in a concrete mixture to create a concrete matrix with greater tensile strain capacities than a traditional concrete mixture. In other words, ECC is one specific species of fiber reinforced concrete (FRC) that uses polymer fibers so as to provide superior qualities. Unlike regular concrete, ECC has a strain capacity in the range of 3-7%, compared to 0.1% for Ordinary Portland Cement (OPC). ECC therefore acts more like a ductile metal than a brittle glass (as does OPC concrete). Tests done on ECC material have shown a higher relative strength in tension, greater resistance to catastrophic fatigue cracking, increased durability under reversed loading, and greater dynamic tensile loading capability under projectile impact. More specifically, in some cases, the tensile strain capacity may be approximately 500 times greater than that of standard concrete aggregate mixtures. In one example, the polymer fibers in the concrete mixture are selected to optimize the concrete matrix for the highest tensile strain capacity. PVA fibers are often selected due to the high chemical bonds between the PVA fiber and the concrete and/or the appropriate frictional stresses at this interface. If the chemical bond and/or frictional interface between the fiber and the concrete mixture is too weak, the fibers will pull out and not transmit force across any micro cracks that may form in the ECC. If the interaction between the fibers and the concrete mixture is too strong, the fibers will not stretch properly and the supporting concrete matrix may rupture. In one embodiment, the strength of the interaction between the fibers and the concrete mixture is in a selected range such that when micro cracks form, they will propagate to other locations in the concrete matrix, thus causing strain hardening in the macro level of the ECC material. There are a number of different varieties of ECC.

"Fastener" generally refers to a hardware device that mechanically joins or otherwise affixes two or more objects together. By way of non-limiting examples, the fastener can include bolts, dowels, nails, nuts, pegs, pins, rivets, screws, buttons, hook and loop fasteners, and snap fasteners, to just name a few.

"Flat" generally refers to an object having a broad level surface but with little height.

"Frame" generally refers to a structure that forms part of an object and gives strength and/or shape to the object.

"Integrally Formed" generally refers to a component and/or multiple components that are fused into a single piece. Integrally formed components are incapable of being dismantled without destroying the integrity of the component.

"Load Deck" generally refers to one or more panels and/or assemblies of boards that form a face of a pallet on which goods and/or other items are carried. For examples, when boxes are stacked on a pallet, the first layer of boxes typically rests on the load deck of the pallet. Typically, but not always, the load deck is located on a side of the pallet that is opposite the support deck.

"Medium Density Fiberboard" or "MDF" generally refers to a material made of small pieces of wood pressed together to form boards.

"Notch" generally refers to an indentation, cut, groove, channel, and/or incision on an edge or surface. In some non-limiting examples, the notch includes a V-shaped or U-shaped indentation carved, scratched, etched, stamped, and/or otherwise formed in the edge or surface. The notch can have a uniform shape or a non-uniform shape.

"Pallet" generally refers to a portable platform or other structure on which goods or items can be assembled, stacked, stored, packaged, handled, transported, and/or moved, such as with the aid of a forklift or pallet jack, as a unit load. Typically, but not always, the pallet is rigid and forms a horizontal base upon which the items rest. Goods, shipping containers, and other items are often placed on a pallet secured with strapping, stretch wrap, and/or shrink wrap. Often, but not always, the pallet is equipped with a superstructure. In one form, the pallet includes structures that support goods in a stable fashion while being lifted by a forklift, pallet jack, front loader, and/or other lifting devices. In particular, pallets typically include a top, load deck upon which items are stacked, a bottom, support deck that rests on the ground, and a spacer structure positioned between the load and support decks to receive the forks of the forklift or pallet jack. However, the pallets can be configured differently. For example, the term pallet is used in a broader sense to include skids that have no support deck. One or more components of the pallet, or even the entire pallet, can be integrally formed together to form a single unit. By way of non-limiting examples, these pallets can include stringer, block, perimeter, skid, solid deck, multiple deck board, panel-deck, slave, double-deck (or face), single-way entry, two-way entry, four-way entry, flush, single-wing, double-wing, expendable, limited-use, multiple-use, returnable, recycled, heat treated, reversible, non-reversible, and/or warehouse type pallets.

"Plastic" generally refers to a synthetic or semi-synthetic material made from a wide range of organic polymers, such as polyethylene, PVC, nylon, and like. Typically, but not always, plastics are mostly thermoplastic or thermosetting polymers of high molecular weight and that can be made into objects, films, or filaments. In some cases, plastics can be molded into shape while soft and then set into a rigid or slightly elastic form.

"Polystyrene Foam" generally refers to a substance in which pockets of gas are trapped in a synthetic aromatic polymer made from the monomer styrene. In other words, polystyrene foam generally refers to a multicellular expanded and/or extruded synthetic resinous material. The polystyrene material is typically, but not always, foamed with the aid of a blowing agent, such as chlorofluorocarbon (now typically banned due to environmental concerns), pentane, and/or carbon dioxide gas blowing agents, to name just a few examples, in order to form bubbles in the polystyrene foam. The trademark STYROFOAM® by Dow Chemical Company is commonly used to refer to all forms of polystyrene foam products. The term polystyrene foam is used in a broad context to include expanded polystyrene (EPS) and extruded polystyrene.

"Spacer Structure" generally refers to any component, part, object, device, and/or assembly that separates the load deck from an object on which the pallet rests, such as the ground, floor, other pallet, and/or other unit load. By way of nonlimiting examples, the spacer structure can include one or more blocks, legs, stringers, and/or other spacers. Typically, but not always, the spacer structure defines one or more fork entries that each form an entry for admitting one or more forks of a forklift or pallet jack. The fork entry can for instance be formed by the space created between the load and support decks by stringers and/or blocks as well as one or more notches in the stringers or other parts of the pallet to name just a few examples. In one form, the fork entries can be located on opposite ends of the pallet to create a two-way entry pallet, and in another form, the fork entries can be located on both opposite ends and opposite sides of the pallet to create a four-way entry pallet. In other examples, the spacer structure can include more or less, and even none, fork entries.

"Sprayable ECC" generally refers to an ECC material that is able to be pneumatically sprayed. Sprayable ECC includes one or more superplasticizing agents and viscosity-reducing admixtures.

"Stock Keeping Unit" (SKU) or "Item" generally refers to an individual article or thing. The SKU can come in any form and can be packaged or unpackaged. For instance, SKUs can be packaged in cases, cartons, bags, drums, containers, bottles, cans, pallets, and/or sacks, to name just a few examples. The SKU is not limited to a particular state of matter such that the item can normally have a solid, liquid, and/or gaseous form for example.

"Substantially" generally refers to the degree by which a quantitative representation may vary from a stated reference without resulting in an essential change of the basic function of the subject matter at issue. The term "substantially" is utilized herein to represent the inherent degree of uncertainty that may be attributed to any quantitative comparison, value, measurement, and/or other representation.

"Support Deck" generally refers to one or more panels and/or assemblies of boards that form a face of a pallet that typically (but not always) rests against another object, such as the floor, ground, other pallet, and/or other unit load, to carry the weight of the pallet and any load packed on the pallet. Typically, but not always, the support deck is located on a side of the pallet that is opposite the load deck. The support deck usually, but not always, includes one or more jack openings that allow pallet jack wheels to engage the floor and/or ground on which the support deck rests.

"Symmetric" or "Symmetrical" generally refers to a property of something having two sides or halves that are the same relative to one another, such as in shape, size, and/or style. In other words, symmetric describes something as having a mirror-image quality.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

REFERENCE NUMBERS

| | |
|---|---|
| 100 pallet | 1120 inserts |
| 105 deck | 1205 corner inserts |
| 110 spacer structure | 1210 middle insert |
| 115 load deck | 1215 brace |
| 120 leg-plank bridges | 1220 outer bridge cap |
| 125 legs | 1225 ribs |

-continued

| | |
|---|---|
| 130 plank | 1405 rim wall |
| 135 fork openings | 1410 hub |
| 140 lead sides | 1415 spoke walls |
| 145 lateral sides | 1420 hub cavity |
| 305 outer leg-plank bridges | 1425 spoke cavities |
| 310 inner leg-plank bridge | 1430 edges |
| 405 sockets | 1435 depressions |
| 805 tray | 1505 ribs |
| 810 frame | 1510 brace channels |
| 815 deck cap | 1605 base |
| 820 weld points | 1610 stem |
| 830 grip cups | 1615 petals |
| 835 peripheral wall | 1620 foot |
| 840 deck cavity | 1625 hub channel |
| 845 beams | 1630 spoke channels |
| 1005 corner socket | 2005 brace notches |
| 1010 middle socket | 2405 fill chambers |
| 1015 end socket | 2505 concrete |
| 1105 corner legs | 2605 rim wall |
| 1110 middle leg | 2610 hub |
| 1115 outer bridge body | 2615 spoke walls |
| 2620 hub cavity | 4205 brace notches |
| 2625 spoke cavities | 4605 fill chambers |
| 2630 edges | 4800 vibration welder |
| 2635 depressions | 4805 locating pins |
| 2805 base | |
| 2810 stem | |
| 2815 petals | |
| 2825 hub channel | |
| 2830 spoke channels | |
| 3305 end legs | |
| 3315 inner bridge body | |
| 3405 end inserts | |
| 3420 inner bridge cap | |
| 3605 rim wall | |
| 3610 hub | |
| 3615 spoke walls | |
| 3620 hub cavity | |
| 3625 spoke cavities | |
| 3630 edges | |
| 3635 depressions | |
| 3705 ribs | |
| 3710 brace channels | |
| 3805 base | |
| 3810 stem | |
| 3815 petals | |
| 3820 foot | |
| 3825 hub channel | |
| 3830 spoke channels | |

What is claimed is:

1. A pallet, comprising:

a deck;

at least two legs extending from the deck;

a plank coupled to the legs;

wherein the plank extends in a longitudinal direction between opposing lead sides of the pallet;

wherein the legs and the deck at least in part define a fork opening at one of the lead sides of the pallet;

wherein the fork opening is configured to receive a fork that extends in the longitudinal direction when inside the fork opening;

wherein each of the legs has one or more walls that define at least two cavities within the leg;

wherein the cavities include a lead side cavity and an interior side cavity;

wherein the lead side cavity is positioned at the lead side of the pallet;

wherein the interior side cavity is positioned opposite the lead side cavity;

concrete filling the lead side cavity to strengthen the leg against impacts by the fork;

a foam insert made of foam extending within the interior side cavity, wherein the foam insert include a base, a stem extending from the base, and one or more petals extending around the stem; and wherein the lead side cavity is empty of the foam insert.

2. The pallet of claim 1, wherein the legs and the plank are integrally formed together as an integrated part.

3. The pallet of claim 1, wherein:

the legs are made of plastic; and the concrete is an Engineered Concrete Composite (ECC) material.

4. The pallet of claim 1, wherein:

each of the legs include a rim wall, a hub located inside the rim wall, and one or more spoke walls extending in a radial direction from the hub to the rim wall;

the hub defines a hub cavity; and the rim wall, the hub, and the spoke walls define one or more spoke cavities.

5. The pallet of claim 4, wherein:

the spoke cavities include the lead side cavity and the interior side cavity;

at least one of the petals extend into the interior side cavity; and the lead side cavity is empty of the petals.

6. The pallet of claim 5, wherein the stem extends into the hub cavity.

7. The pallet of claim 6, wherein:

the spoke walls have edges;

the edges curve towards the hub to define one or more depressions;

the depressions are filled with the concrete; and the stem and the petal have ends that extend into one of the depressions.

8. A pallet, comprising:

a deck;

one or more leg-plank bridges are attached to the deck, wherein the leg-plank bridges include at least two legs extending from the deck, wherein each of the legs includes a rim wall, a hub located inside the rim wall, and one or more spoke walls extending in a radial direction from the hub to the rim wall, and a plank extending between the legs;

wherein the hub defines a hub cavity;

wherein the rim wall, the hub, and the spoke walls define a plurality of spoke cavities;

wherein the spoke cavities are wedge shaped;

an insert made of foam;

wherein the insert includes a base and a plurality of petals extending from the base;

wherein the insert has a stem extending from the base;

wherein the petals extend in the radial direction from the stem;

wherein the base is positioned outside of the spoke cavities and the hub cavity;

wherein the petals of the insert extend from the base to fill at least some of the spoke cavities; and wherein the stem extends into the hub cavity.

9. The pallet of claim 8, wherein the petals extend into all of the spoke cavities.

10. The pallet of claim 8, wherein:

the legs have a lead end;

the spoke cavities at the lead end are filled with concrete; and the petals extend into the spoke cavities located opposite to the lead end.

11. The pallet of claim 10, wherein:

the insert includes a foot;

the foot extends from the base;

the foot extends opposite to the petals; and the foot extends to the petals filled with the concrete.

12. The pallet of claim 8, further comprising:

a brace extending inside the plank;

wherein the brace has one or more ribs; and wherein the base defines one or more notches receiving the ribs of the brace.

13. The pallet of claim 8, wherein:

the spoke walls have edges;

the edges curve towards the hub to define one or more depressions;

the depressions are filled with concrete; and the stem and the petal have ends that extend into one of the depressions.

14. The pallet of claim 8, wherein the legs and the plank are integrally formed together as an integrated part.

15. A pallet, comprising:

a deck;

one or more legs extending from the deck;

wherein each of the legs has one or more walls that define one or more cavities;

wherein at least one of the cavities are filled with concrete;

wherein the concrete fills the cavities located on a lead end of the pallet;

wherein the remaining cavities are filled with foam;

wherein the foam includes an insert received in the legs, wherein the insert includes a base, a stem extending from the base, and one or more petals extending around the stem;

wherein each of the legs include a rim wall, a hub located inside the rim wall, and one or more spoke walls extending in a radial direction from the hub to the rim wall;

wherein the hub defines a hub cavity;

wherein the rim wall, the hub, and the spoke walls define one or more spoke cavities;

wherein the spoke cavities at a lead end are filled with concrete;

wherein the petals of the insert extend into the spoke cavities located opposite to the lead end;

wherein the stem extends into the hub cavity;

wherein the spoke walls have edges;

wherein the edges curve towards the hub to define one or more depressions;

wherein the depressions are filled with the concrete; and wherein the stem and the petal have ends that extend into one of the depressions.

16. A pallet, comprising:

a deck;

one or more leg-plank bridges are attached to the deck, wherein the leg-plank bridges include at least two legs extending from the deck, wherein the legs include a rim wall, a hub located inside the rim wall, and one or more spoke walls extending in a radial direction from the hub to the rim wall, and a plank extending between the legs;

wherein the hub defines a hub cavity;

wherein the rim wall, the hub, and the spoke walls define one or more spoke cavities;

an insert including a base, a stem extending from the base, wherein the stem extends into the hub cavity, and one or more petals extending around the stem, wherein the petals extend in an outer radial direction from the stem, wherein the petals extend into the spoke cavities;

wherein the spoke walls have edges;

wherein the edges curve towards the hub to define one or more depressions;

wherein the depressions are filled with concrete; and wherein the stem and the petal have ends that extend into one of the depressions.

17. A pallet, comprising:

a deck;

a leg extending from the deck;

wherein the leg in part defines a fork opening configured to receive a fork;

wherein the leg has a lead side on an exterior of the leg that faces towards the fork when being received into the fork opening;

wherein the leg has an interior side located opposite the lead side;

wherein the leg has a plurality of spoke walls extending in a radial direction inside of the leg;

wherein the spoke walls define a plurality of cavities;

wherein the cavities include a plurality of lead side cavities and a plurality of interior side cavities;

wherein the lead side cavities are positioned at the lead side of the leg;

concrete filling the lead side cavities to strengthen the leg against impacts by the fork;

an insert made of foam;

wherein the insert includes a base and a plurality of petals extending from the base;

wherein the base is positioned outside of the cavities;

wherein each of the petals have a wedge shape;

wherein the petals of the insert extend from the base into the interior side cavities to fill the interior side cavities; and wherein the lead side cavities of the leg are empty of the petals.

18. The pallet of claim 17, wherein:

the leg has a hub that defines a hub cavity;

the spoke walls extend in the radial direction from the hub;

the insert has a stem extending from the base; and the stem extends into the hub cavity.

19. The pallet of claim 17, wherein the lead side of the leg is more prone to being impacted with the fork than the interior side.

* * * * *